US012161920B2

(12) United States Patent
Mata et al.

(10) Patent No.: US 12,161,920 B2
(45) **Date of Patent: *Dec. 10, 2024**

(54) WEIGHTED IRON SET

(71) Applicant: Acushnet Company, Fairhaven, MA (US)

(72) Inventors: Jason A. Mata, Carlsbad, CA (US); Marni D. Ines, San Marcos, CA (US); Jonathan Hebreo, San Diego, CA (US); Joshua G. Breier, Vista, CA (US); Michael E. Franz, San Diego, CA (US); Joshua C. Stokes, Pinehurst, NC (US); Grant M. Martens, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/951,243

(22) Filed: Sep. 23, 2022

(65) Prior Publication Data

US 2023/0021981 A1 Jan. 26, 2023

Related U.S. Application Data

(63) Continuation of application No. 17/117,758, filed on Dec. 10, 2020, now Pat. No. 11,478,684, which is a continuation of application No. 16/589,398, filed on Oct. 1, 2019, now Pat. No. 10,881,924, which is a continuation of application No. 15/951,071, filed on Apr. 11, 2018, now Pat. No. 10,463,933, which is a (Continued)

(51) Int. Cl.

*A63B 53/04* (2015.01)
*A63B 53/00* (2015.01)

(52) U.S. Cl.

CPC ..... *A63B 53/047* (2013.01); *A63B 53/0475* (2013.01); *A63B 53/005* (2020.08); *A63B 53/0408* (2020.08); *A63B 53/0412* (2020.08); *A63B 53/0416* (2020.08); *A63B 53/0433* (2020.08); *A63B 2053/0491* (2013.01); *A63B 2209/00* (2013.01)

(58) Field of Classification Search

CPC ..... A63B 53/04; A63B 53/0416; A63B 53/042; A63B 53/047; A63B 53/0475

USPC ..... 473/324–350

See application file for complete search history.

(56) References Cited

U.S. PATENT DOCUMENTS 1,945,844 A 2/1934 Young
3,845,955 A 11/1974 Solheim (Continued)

FOREIGN PATENT DOCUMENTS

JP 4241883 8/1992
JP 6154368 6/1994

(Continued)

OTHER PUBLICATIONS

Jackson, Jeff, "The Modern Guide to Golf Clubmaking", Ohio: Dynacraft Golf Products, Inc., Copyright 1994, p. 236.

*Primary Examiner* — Alvin A Hunter
(74) *Attorney, Agent, or Firm* — Mike S. Kim

(57) ABSTRACT

The present invention is direct to a set of golf clubs comprising long irons, mid-irons and short irons. The invention contemplates the use of titanium or steel for the main body portion and a tungsten weight member coupled to the toe and a tungsten heel weight member coupled in a hosel cavity.

13 Claims, 17 Drawing Sheets

Related U.S. Application Data continuation-in-part of application No. 15/829,534, filed on Dec. 1, 2017, now Pat. No. 10,357,697, which is a continuation-in-part of application No. 15/261,464, filed on Sep. 9, 2016, now Pat. No. 10,004,957, which is a continuation-in-part of application No. 14/964,169, filed on Dec. 9, 2015, now Pat. No. 9,750,993, which is a continuation-in-part of application No. 14/626,531, filed on Feb. 19, 2015, now abandoned.

(56) References Cited

U.S. PATENT DOCUMENTS

| | | | |
|---|---|---|---|
| 3,897,065 | A | 7/1975 | Solheim |
| 3,995,865 | A | 12/1976 | Cochran |
| 4,313,607 | A | 2/1982 | Thompson |
| 4,645,207 | A | 2/1987 | Teramoto |
| 4,687,205 | A | 8/1987 | Tominaga |
| 4,754,969 | A | 7/1988 | Kobayashi |
| 4,754,971 | A | 7/1988 | Kobayashi |
| 4,824,110 | A | 4/1989 | Kobayashi |
| 4,836,550 | A | 6/1989 | Kobayashi |
| 4,854,580 | A | 8/1989 | Kobayashi |
| 4,854,581 | A | 8/1989 | Long |
| 4,874,171 | A | 10/1989 | Ezaki et al. |
| 5,048,835 | A | 9/1991 | Gorman |
| 5,282,625 | A | 2/1994 | Schmidt et al. |
| 5,295,686 | A | 3/1994 | Lundberg |
| 5,316,297 | A | 5/1994 | Chappell |
| 5,326,105 | A | 7/1994 | Fenton, Jr. |
| 5,409,229 | A | 4/1995 | Schmidt et al. |
| 5,429,353 | A | 7/1995 | Hoeflich |
| 5,447,311 | A | 9/1995 | Viollaz et al. |
| 5,472,203 | A | 12/1995 | Schmidt et al. |
| 5,492,327 | A | 2/1996 | Biafore, Jr. |
| 5,524,880 | A | 6/1996 | Kobayashi |
| 5,547,426 | A | 8/1996 | Wood |
| 5,549,296 | A | 8/1996 | Gilbert |
| 5,564,705 | A | 10/1996 | Kobayasi et al. |
| 5,605,511 | A | 2/1997 | Schmidt et al. |
| 5,669,825 | A | 9/1997 | Shira |
| 5,669,826 | A | 9/1997 | Chang |
| D389,540 | S | 1/1998 | Mendenhall |
| 5,704,849 | A | 1/1998 | Schmidt et al. |
| 5,722,900 | A | 3/1998 | Sung |
| 5,749,795 | A | 5/1998 | Schmidt et al. |
| 5,800,281 | A | 9/1998 | Gilbert |
| 5,830,084 | A | 11/1998 | Kosmatka |
| 5,833,551 | A | 11/1998 | Vincent et al. |
| D404,453 | S | 1/1999 | Wozny et al. |
| D404,780 | S | 1/1999 | Long |
| 5,935,020 | A | 8/1999 | Stites et al. |
| 5,971,868 | A | 10/1999 | Kosmatka |
| 5,984,803 | A | 11/1999 | Chappell |
| 6,030,293 | A | 2/2000 | Takeda |
| 6,030,295 | A | 2/2000 | Takeda |
| 6,042,486 | A | 3/2000 | Gallagher |
| 6,080,069 | A | 6/2000 | Long |
| 6,089,990 | A | 7/2000 | Kimura |
| 6,093,112 | A | 7/2000 | Peters |
| D429,511 | S | 8/2000 | Adams et al. |
| 6,095,931 | A | 8/2000 | Hettinger et al. |
| D438,584 | S | 3/2001 | Adams et al. |
| D438,925 | S | 3/2001 | Adams et al. |
| D438,926 | S | 3/2001 | Adams et al. |
| 6,210,290 | B1 | 4/2001 | Erickson et al. |
| 6,290,607 | B1 | 9/2001 | Gilbert et al. |
| 6,315,678 | B1 | 11/2001 | Teramoto |
| D453,949 | S | 2/2002 | Helmstetter et al. |
| 6,358,158 | B2 | 3/2002 | Peters |
| 6,379,263 | B2 | 4/2002 | Erickson et al. |
| 6,440,010 | B1 | 8/2002 | Deshmukh |
| 6,471,601 | B1 | 10/2002 | McCabe et al. |
| 6,482,104 | B1 | 11/2002 | Gilbert |
| 6,554,722 | B2 | 4/2003 | Erickson et al. |
| D476,708 | S | 7/2003 | Wahl et al. |
| 6,595,870 | B2 | 7/2003 | Stites et al. |
| 6,602,147 | B2 | 8/2003 | Shiraishi |
| 6,623,374 | B1 | 9/2003 | Helmstetter et al. |
| 6,645,085 | B2 | 11/2003 | McCabe et al. |
| D489,106 | S | 4/2004 | Wahl et al. |
| 6,719,641 | B2 | 4/2004 | Dabbs et al. |
| 6,769,998 | B2 | 8/2004 | Clausen et al. |
| 6,780,123 | B2 | 8/2004 | Hasebe |
| 6,814,674 | B2 | 11/2004 | Clausen et al. |
| D500,350 | S | 12/2004 | Schweigert et al. |
| D500,351 | S | 12/2004 | Schweigert et al. |
| 6,830,519 | B2 | 12/2004 | Reed et al. |
| 6,832,962 | B2 | 12/2004 | Stites et al. |
| 6,835,144 | B2 | 12/2004 | Best |
| D501,035 | S | 1/2005 | Wahl et al. |
| 6,855,069 | B2 | 2/2005 | Nagai et al. |
| 6,857,973 | B2 | 2/2005 | Wieland |
| 6,860,819 | B2 | 3/2005 | Gilbert |
| D505,466 | S | 5/2005 | Lang et al. |
| 6,896,627 | B2 | 5/2005 | Hou |
| 6,902,495 | B2 | 6/2005 | Pergande et al. |
| 6,923,732 | B2 | 8/2005 | Stites et al. |
| 6,932,717 | B2 | 8/2005 | Hou et al. |
| D510,115 | S | 9/2005 | Lang et al. |
| 6,981,924 | B2 | 1/2006 | Deshmukh |
| 6,984,180 | B2 | 1/2006 | Hasebe |
| 6,991,559 | B2 | 1/2006 | Yabu |
| 7,004,853 | B2 | 2/2006 | Deshmukh |
| D517,625 | S | 3/2006 | Sanchez et al. |
| 7,014,568 | B2 | 3/2006 | Pelz |
| D518,539 | S | 4/2006 | Cleveland et al. |
| 7,022,028 | B2 | 4/2006 | Nagai et al. |
| 7,083,531 | B2 | 8/2006 | Aguinaldo et al. |
| 7,112,148 | B2 | 9/2006 | Deshmukh |
| D530,760 | S | 10/2006 | Schweigert et al. |
| 7,126,339 | B2 | 10/2006 | Nagai et al. |
| D532,848 | S | 11/2006 | Cleveland et al. |
| 7,137,903 | B2 | 11/2006 | Best et al. |
| 7,144,336 | B2 | 12/2006 | Reyes et al. |
| 7,144,337 | B2 | 12/2006 | Hirano |
| 7,147,571 | B2 | 12/2006 | Best et al. |
| 7,186,187 | B2 | 3/2007 | Gilbert et al. |
| 7,186,188 | B2 | 3/2007 | Gilbert et al. |
| 7,192,361 | B2 | 3/2007 | Gilbert et al. |
| 7,192,362 | B2 | 3/2007 | Gilbert et al. |
| 7,232,380 | B2 | 6/2007 | Nakahara |
| 7,238,119 | B2 | 7/2007 | Roach et al. |
| 7,281,989 | B2 | 10/2007 | Hou et al. |
| 7,410,424 | B2 | 8/2008 | Chen |
| 7,442,130 | B2 | 10/2008 | Ban et al. |
| 7,448,961 | B2 | 11/2008 | Lin |
| 7,476,162 | B2 | 1/2009 | Stites et al. |
| 7,530,902 | B2 | 5/2009 | Nakamura |
| 7,559,850 | B2 | 7/2009 | Gilbert et al. |
| 7,563,176 | B2 | 7/2009 | Roberts et al. |
| 7,591,735 | B2 | 7/2009 | Matsunaga et al. |
| 7,614,962 | B1 | 11/2009 | Clausen |
| 7,651,412 | B2 | 1/2010 | Meyer et al. |
| 7,654,914 | B2 | 2/2010 | Roach et al. |
| 7,662,051 | B2 | 2/2010 | Chen |
| 7,699,716 | B2 | 4/2010 | Burnett et al. |
| 7,713,141 | B2 | 5/2010 | Yamamoto |
| 7,775,906 | B2 | 8/2010 | Kusumoto |
| 7,815,523 | B2 | 10/2010 | Knutson et al. |
| 7,935,000 | B2 | 5/2011 | Stites |
| 7,976,403 | B2 | 7/2011 | Gilbert et al. |
| 7,980,960 | B2 | 7/2011 | Gilbert |
| 7,988,564 | B2 | 8/2011 | Jertson |
| 8,012,040 | B2 | 9/2011 | Takechi |
| 8,062,150 | B2 | 11/2011 | Gilbert et al. |
| 8,079,919 | B2 | 12/2011 | Roach et al. |
| 8,133,129 | B2 | 3/2012 | Boyd et al. |
| 8,147,353 | B2 | 4/2012 | Gilbert et al. |
| 8,157,673 | B2 | 4/2012 | Gilbert |
| 8,197,355 | B2 | 6/2012 | Galloway, Sr. |
| 8,206,237 | B2 | 6/2012 | Gilbert et al. |
| 8,235,832 | B2 | 8/2012 | Burnett et al. |

(56) References Cited

U.S. PATENT DOCUMENTS

| | | | | |
|---|---|---|---|---|
| 8,241,141 | B2 | 8/2012 | Takechi | |
| 8,257,198 | B2 | 9/2012 | Gilbert et al. | |
| 8,342,985 | B2 | 1/2013 | Hirano | |
| 8,435,132 | B2 | 5/2013 | Oldknow | |
| 8,491,407 | B2 | 7/2013 | Shear et al. | |
| 8,608,585 | B2 | 12/2013 | Stites et al. | |
| 8,608,589 | B2 | 12/2013 | Ferguson et al. | |
| 8,740,721 | B2 | 6/2014 | Yamamoto | |
| 8,753,219 | B2 | 6/2014 | Gilbert et al. | |
| 8,758,163 | B2 | 6/2014 | Stites et al. | |
| 8,821,313 | B1 | 9/2014 | Dawson | |
| 9,011,270 | B2 | 4/2015 | Nakano | |
| 10,357,697 | B2 * | 7/2019 | Breier | A63B 53/047 |
| 10,463,933 | B2 * | 11/2019 | Mata | A63B 53/0475 |
| 10,881,924 | B2 * | 1/2021 | Mata | A63B 53/0475 |
| 11,478,684 | B2 * | 10/2022 | Mata | A63B 53/0475 |
| 2003/0181259 | A1 | 9/2003 | Shimazaki | |
| 2003/0199331 | A1 | 10/2003 | Stites, III | |
| 2003/0029846 | A1 | 12/2003 | Takeda | |
| 2004/0058746 | A1 | 3/2004 | Kusumoto | |
| 2005/0037863 | A1 | 2/2005 | Gilbert | |
| 2005/0170908 | A1 | 8/2005 | Reyes et al. | |
| 2005/0239570 | A1 | 10/2005 | Best et al. | |
| 2007/0129168 | A1 | 6/2007 | Matsunaga et al. | |
| 2007/0281796 | A1 | 12/2007 | Gilbert | |
| 2008/0102982 | A1 | 5/2008 | Wahl | |
| 2008/0161124 | A1 | 7/2008 | Kajita | |
| 2008/0242444 | A1 | 10/2008 | Park et al. | |
| 2008/0318705 | A1 | 12/2008 | Clausen et al. | |
| 2010/0093460 | A1 | 4/2010 | Gilbert et al. | |
| 2010/0273565 | A1 | 10/2010 | Stites et al. | |
| 2010/0304886 | A1 | 12/2010 | Boyd et al. | |
| 2010/0331098 | A1 | 12/2010 | Gilbert | |
| 2011/0086723 | A1 | 4/2011 | Gilbert | |
| 2011/0250985 | A1 | 10/2011 | Stites et al. | |
| 2012/0122606 | A1 | 5/2012 | Yamamoto | |
| 2013/0344988 | A1 | 12/2013 | Hettinger | |
| 2013/0344989 | A1 | 12/2013 | Hebreo | |
| 2016/0243412 | A1 | 8/2016 | Ines | |
| 2016/0243413 | A1 | 8/2016 | Ritchie | |
| 2016/0361609 | A1 | 12/2016 | Ines et al. | |
| 2017/0050092 | A1 | 2/2017 | Ines et al. | |
| 2018/0185717 | A1 | 7/2018 | Demkowski | |

FOREIGN PATENT DOCUMENTS

| | | |
|---|---|---|
| JP | H06-48724 | 7/1994 |
| JP | H06-41565 | 11/1994 |
| JP | 7236714 | 9/1995 |
| JP | 8038658 | 2/1996 |
| JP | H08-38658 | 2/1996 |
| JP | H08-112380 | 5/1996 |
| JP | 9215792 | 8/1997 |
| JP | H 09271545 | 10/1997 |
| JP | 10263122 | 10/1998 |
| JP | 11319153 | 11/1999 |
| JP | 2000084128 | 3/2000 |
| JP | 2000210398 | 8/2000 |
| JP | 2001095959 | 4/2001 |
| JP | 2001170222 | 6/2001 |
| JP | 2001204863 | 7/2001 |
| JP | 2001212266 | 8/2001 |
| JP | 2001259092 | 9/2001 |
| JP | 2001299968 | 10/2001 |
| JP | 2001314535 | 11/2001 |
| JP | 2002143355 | 5/2002 |
| JP | 2002-533180 | 10/2002 |
| JP | 2003062132 | 3/2003 |
| JP | 2003245386 | 9/2003 |
| JP | 2006051366 | 2/2006 |
| JP | 2006-81862 | 3/2006 |
| JP | 2006-141710 | 6/2006 |
| JP | 2006198327 | 8/2006 |
| JP | 2006212066 | 8/2006 |
| JP | 2006-320493 | 11/2006 |
| JP | 2007275231 | 10/2007 |
| JP | 2011-520565 | 7/2011 |
| JP | 2012-525214 | 10/2012 |
| JP | 2013-13717 | 1/2013 |
| JP | 2013-523389 | 6/2013 |

* cited by examiner

WEIGHTED IRON SET

RELATED APPLICATIONS

The present application is a continuation of co-pending U.S. application Ser. No. 17/117,758, filed on Dec. 10, 2020, which is a continuation of U.S. application Ser. No. 16/589,398, filed on Oct. 1, 2019 and issued as U.S. Pat. No. 10,881,924 on Jan. 5, 2021, which is a continuation of U.S. application Ser. No. 15/951,071, filed on Apr. 11, 2018 and issued as U.S. Pat. No. 10,463,933 on Nov. 5, 2019, which is a continuation-in-part of U.S. application Ser. No. 15/829,534, filed on Dec. 1, 2017 and issued as U.S. Pat. No. 10,357,697 on Jul. 23, 2019, which is a continuation-in-part of U.S. application Ser. No. 15/261,464, filed on Sep. 9, 2016 and issued as U.S. Pat. No. 10,004,957 on Jun. 26, 2018, which is a continuation-in-part of U.S. application Ser. No. 14/964,169, filed on Dec. 9, 2015 and issued as U.S. Pat. No. 9,750,993 on Sep. 5, 2017, which is a continuation-in-part of U.S. application Ser. No. 14/626,531, filed on Feb. 19, 2015, now abandoned, which are all hereby incorporated by reference in their entirety.

TECHNICAL FIELD OF THE INVENTION

The present invention generally relates to sets of iron golf clubs, and more particularly, to sets of iron golf clubs that are comprised of significant tungsten weighting.

BACKGROUND OF THE INVENTION

In conventional sets of "iron" golf clubs, each club includes a shaft with a club head attached to one end and a grip attached to the other end. The club head includes a face for striking a golf ball. The angle between the face and a vertical plane is called "loft." In general, the greater the loft is of the golf club in a set, the greater the launch angle and the less distance the golf ball is hit.

A set of irons generally includes individual irons that are designated as number 3 through number 9, and a pitching wedge. The iron set is generally complimented by a series of wedges, such as a lob wedge, a gap wedge, and/or a sand wedge. Sets can also include a 1 iron and a 2 iron, but these clubs are generally sold separate from the set. Each iron has a shaft length that usually decreases through the set as the loft for each club head increases, from the long irons to the short irons. The length of the club, along with the club head loft and center of gravity impart various performance characteristics to the ball's launch conditions upon impact. The initial trajectory of the ball generally extends between the impact point and the apex or peak of the trajectory. In general, the ball's trajectory for long irons, like the 3 iron, is a more penetrating, lower trajectory due to the lower launch angle and the increased ball speed off of the club. Short irons, like the 8 iron or pitching wedge, produce a trajectory that is substantially steeper and less penetrating than the trajectory of balls struck by long irons. The highest point of the long iron's ball flight is generally lower than the highest point for the short iron's ball flight. The mid irons, such as the 5 iron, produce an initial trajectory that is between those exhibited by balls hit with the long and short irons.

SUMMARY OF THE INVENTION

The present invention is directed to a set of golf clubs comprising at least a first club head having a loft between about 15 and 25 degrees (long irons), a second club head having a loft of between about 26 and 35 degrees (mid irons), and a third club head having a loft of about 36 degrees or greater (short irons). Within the set, the first, second and third club heads each have a heel, a toe, a topline, a sole, a hosel and a front face having a face center. Each of the club heads has a club head mass that is different than the other club head mass by at least 5 grams. Further, the set includes at least one club head that has a tungsten heel member and a tungsten toe member that together comprise more that 50% of the club head mass. More preferably, each of the long irons and the mid irons are comprised of tungsten weight members that are at least 50% of the club head mass.

The present invention is also directed to a set of irons where the long and mid irons each have a tungsten heel member and a tungsten toe member, wherein the tungsten heel member plus the tungsten toe member weigh 135 grams or greater. Preferably, the long and mid irons are comprised of titanium and tungsten and the tungsten portion forms more than 25% of the club heads' volume. In a preferred embodiment, the short iron is comprised of titanium and steel and the steel portion comprises between 50% and 70% of the club head mass.

The present invention is also directed to a set of golf clubs comprising at least a first club head having a loft between about 15 and 25 degrees, a second club head having a loft of between about 26 and 35 degrees, and a third club head having a loft of about 36 degrees or greater, where each club head has a club head mass that is different than the one preceding it by at least 5 grams and at least one club head is comprised of a steel body member and a steel face insert that together comprise less than 75 percent of the overall club head mass. Preferably, the club head includes a tungsten heel member and a tungsten toe member that together comprise more that 25% of the club head mass. More preferably, the tungsten heel member plus the tungsten toe member weigh 70 grams or greater.

In a preferred embodiment of the invention, the long irons and mid irons are comprised of steel and tungsten and the tungsten portion forms at least about 20 percent of the club heads' solid volume. Still further, at least one short iron can be comprised of steel and tungsten and the tungsten portion comprises at least about 20 percent of the club head mass.

The present invention also contemplates a set of golf clubs comprising at least a long iron having a first blade length, a first hosel length and a first scoreline width, a mid iron having a second blade length, a second hosel length and a second scoreline width, and a short iron having a third blade length, a third hosel length and a third scoreline width, where the blade lengths are approximately constant and the second hosel length is greater than the first hosel length and the third hosel length is greater than the second hosel length. Also the second scoreline width is preferably less than the first scoreline width and the third scoreline width is preferably less than the second scoreline width. In a preferred embodiment, the long iron has a first toe height, the mid iron has a second toe height greater than the first toe height and the short iron has a third toe height greater than the second toe height. Still further, the long iron can have a first sole width, the mid iron can have a second sole width less than the first sole width and the short iron can have a third sole width less than the second sole width.

In the preferred embodiment of the current invention, the long iron has a first tungsten toe member, the mid iron has a second tungsten toe member with greater mass than the first tungsten toe member and at least one short iron has a third tungsten toe member with greater mass than the second tungsten toe member. Conversely, in the preferred embodiment, the long iron has a first tungsten heel member and the mid iron has a second tungsten heel member with less mass than the first tungsten heel member.

The present invention is also directed to a set of golf clubs comprising at least a first club head having a loft between about 15 and 25 degrees, a second club head having a loft of between about 26 and 35 degrees, and a third club head having a loft of about 36 degrees or greater, wherein each club head having a club head mass that is different than the previous club head by at least 5 grams, and wherein at least one of the club heads includes a weight member formed of tungsten and coupled to the toe that comprises 15%-25% of the club head mass. More preferably, the weight member is coupled to the golf club to form a portion of the back surface, the toe surface and the sole surface via a mechanical fastener. The club head can also include an indentation that forms a wall surrounding a portion of the weight member that has an angle between about 10 degrees and 60 degrees such that the weight member is press fit against the wall when the mechanical fastener is tightened. The club can also include a bottom surface and an adhesive tape is juxtaposed the bottom surface and the weight member. In a most preferred embodiment, the mechanical fastener is inserted through a face side of the club and extends through an aperture in the club and the club and the weight member form a paint fill edge that surrounds the weight member perimeter.

The present invention is also directed to a set of golf clubs comprising at least a first club head having a loft between about 15 and 25 degrees and a first club head mass, a second club head having a loft of between about 26 and 35 degrees and a second club head mass, and a third club head having a loft of about 36 degrees or greater and a third club head mass, wherein at least one of the clubs is formed with a body made of steel comprising a heel, a toe, a topline, a sole, a hosel, a front face insert and a back wall forming a hollow cavity therebetween. The club head further comprises a toe weight member formed of tungsten coupled to a toe portion of the hollow cavity that is about 25%-35% of the club head mass and a heel weight member formed of tungsten that is coupled into a hosel cavity formed in a front, lower portion of the hosel. The heel weight member is preferably enclosed in the hosel cavity by a steel cover member that forms at least a front portion of the hosel.

In a preferred embodiment of the present invention, both the first and second club heads have toe weight members that are at least 65 grams. Moreover, the first club head has a Moment of Inertia about the y-axis through the face center of greater than 250 kg-mm$^2$. Preferably, the first club head also has a Center of Gravity that is less than 18 mm from a ground surface when the club head is in the standard address position and is greater than 6 mm from the face center toward the back surface. Further still, in a preferred embodiment, the first club head has a Moment of Inertia about the y-axis of greater than 250 kg-mm$^2$ and a blade length of less than 82 mm. Even more preferably, the irons have a blade length that is less than 78 mm.

In a preferred embodiment of the present invention, the Center of Gravity depth from the face center toward the back wall of the hollow irons is almost 1/10 the blade length. Still further, within the set, the Moment of Inertia for the long irons is less than the Moment of Inertia for the mid irons and the Moment of Inertia for the short irons. Within the set, the Center of Gravity for the mid irons is preferably less than 19 mm from a ground surface when the club head is in the standard address position and the Center of Gravity for the short irons is greater than 19 mm from a ground surface when the club head is in the standard address position. More preferably, each of the club heads has a Center of Gravity height from the ground that increases with loft through the set.

Preferably, the present invention comprises at least three hollow long irons, each having a loft of between 15 and 25 degrees, and a combined mass of the toe weight member located in a hollow cavity and the heel weight member located in a lower portion of the hosel that increases with loft. Moreover, the Moment of Inertia about the y-axis for the long irons increases with loft.

The present invention is also directed to a set of hollow irons where the sole has a sole width and a face insert includes a face insert sole portion that extends in a front-to-back direction from a leading edge toward the back wall a distance that is at least 25% of the sole width. It is also preferred that the face insert sole portion extend from the heel toward the toe and has a length in a heel-to-toe direction that is between 50% and 80% of the blade length. It is preferred that the face insert has a face center thickness of 1.8 mm or less and has an Ultimate Tensile Strength of 2300 MPa or greater. More particularly, it is preferred that the face insert has a face center thickness of 1.75 mm or less and has a Fatigue Strength of greater than 800 MPa.

DETAILED DESCRIPTION OF THE PREFERRED EMBODIMENTS

As illustrated in the accompanying drawings and discussed in detail below, the present invention is directed to an improved set of iron-type golf clubs, wherein the clubs have tungsten weight members that form a significant portion of the club heads' mass.

Figure 1:
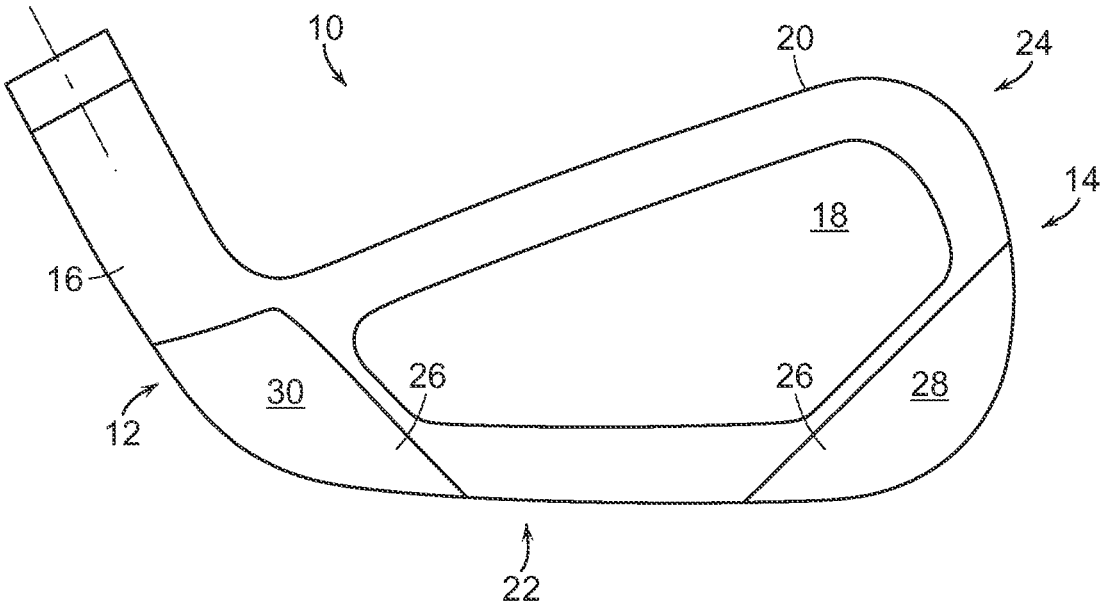
FIG. 1 is a back view of an iron according to the present invention.
Figure 2:
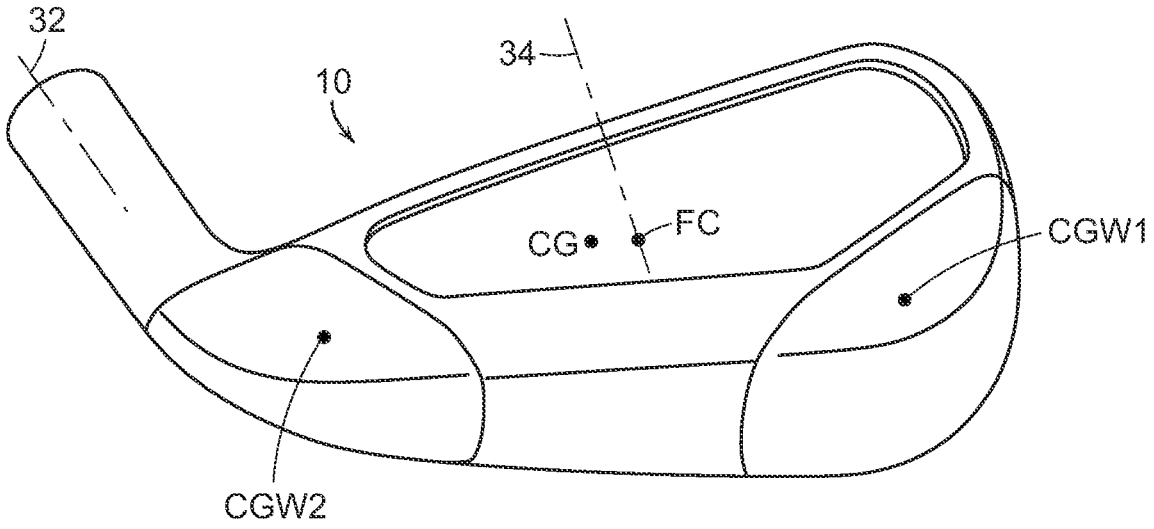
FIG. 2 is a perspective view of the iron in FIG. 1.

Referring to FIGS. 1 and 2, an iron 10 has a heel 12, a toe 14, a hosel 16, a back cavity 18 a top line 20 and a sole 22. The iron is comprised of two main components, the main body 24 and the weight members 26. The iron includes a hosel axis 32 and a Y-axis 34 that extends vertically through a face center FC. The main body 24 is formed from titanium, or more preferably, a titanium alloy. For at least the long irons and mid irons, the weight members include a toe weight member 28 and a heel weight member 30 that are formed from tungsten or more preferably a tungsten alloy having a specific gravity of 15 g/cm3 or greater. Thus, the main body 24 will have a specific gravity of about 4-5 g/cm3 and the weight members 26 will have a specific gravity of about 15-20 g/cm3.

Table I provides exemplary, non-limiting dimensions for the various measurements of clubs according to the Example of the invention. It is fully intended that all of the dimensions set forth below can be adjusted such that the overall objective of the individual irons is met.

TABLE I

| Club Number | 3 | 4 | 5 | 6 | 7 | 8 | 9 | P |
|---|---|---|---|---|---|---|---|---|
| loft | 21 | 24 | 27 | 30 | 34 | 38 | 42 | 46 |
| Mass | 238 | 245 | 252 | 259 | 266 | 274 | 282 | 286 |
| Ti (g) | 103 | 100 | 102 | 109 | 116 | 94 | 102 | 106 |
| W (g) | 135 | 145 | 150 | 150 | 150 | | | |
| Steel (g) | | | | | | 180 | 180 | 180 |

TABLE I-continued

| Club Number | 3 | 4 | 5 | 6 | 7 | 8 | 9 | P |
|---|---|---|---|---|---|---|---|---|
| Ti % | 43.3 | 40.8 | 40.5 | 42.1 | 43.6 | 34.3 | 36.2 | 37.1 |
| W % | 56.7 | 59.2 | 59.5 | 57.9 | 56.4 | | | |
| Steel % | | | | | | 65.7 | 63.8 | 62.9 |
| Ti vol. ($cm^3$) | 22.9 | 22.2 | 22.7 | 24.2 | 25.8 | 20.9 | 22.7 | 23.6 |
| W vol. ($cm^3$) | 9.0 | 9.7 | 10 | 10 | 10 | | | |
| Steel Vol. ($cm^3$) | | | | | | 24 | 24 | 24 |

Referring to the data in Table I above, the set of irons according to the present invention can be separated into long irons that have a loft of between about 15 and 25 degrees, mid irons that have a loft of between about 26 and 35 degrees and short irons that have a loft of about 36 or greater. The total mass of the clubs increases throughout the set from about 235 grams to about 290 grams. Each club is preferably about 5 grams or more greater in mass than the previous iron. As shown, for example, the 4 iron is 7 grams greater than the 3 iron. Thus, the mass increases through the set.

Each of the irons includes a titanium body member. The long irons and the mid irons preferably have tungsten weight members 28 and 30 as shown in FIGS. 1 and 2. In the long irons, the titanium body member 24 has a mass that is less than about 120 grams and more particularly, about 100 grams. The toe weight member 28 and heel weight member 30 preferably have a mass of about 130 grams to 150 grams. Thus, the tungsten weight members are greater than 50% of the total club mass.

In the mid irons, the titanium body member 24 has a mass that is less than about 120 grams and more particularly, about 100 grams to about 115 grams. The tungsten toe weight member 28 and heel weight member 30 preferably have a mass of about 140 grams to 160 grams, and more particularly about 150 grams. Thus, the tungsten weight members are greater than 50% of the total club mass. Also, the tungsten weight members 28 and 30 have greater mass than the tungsten weight members 28 and 30 for the long irons.

In the short irons, the titanium body member 24 has a mass that is less than about 120 grams and more particularly, about 90 grams to about 110 grams. The toe weight member 28 and heel weight member 30 are preferably made of steel and preferably have a mass of about 160 grams to 200 grams, and more particularly about 180 grams. Thus, the steel weight members are greater than 50% of the total club mass. Also, the steel weight members 28 and 30 have greater mass than the tungsten weight members 28 and 30 for the long irons and of the mid irons.

TABLE II

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Total Mass (g) | 234 | 239 | 246 | 252 | 256 | 267 | 274 | 282 | 286 |
| Body Mass (g) | 116 | 117 | 118 | 118 | 132 | 139 | 164 | 170 | 240 |
| Face Mass (g) | 34 | 37 | 38 | 38 | 38 | 39 | 41 | 41 | 41 |
| Toe W (g) | 38 | 45 | 50 | 55 | 61 | 60 | 61 | 63 | |
| Heel W (g) | 34 | 32 | 31 | 31 | 20 | 20 | | | |
| Steel Mass % | 70 | 68 | 67 | 66 | 68 | 70 | 78 | 78 | 100 |
| W Mass % | 30 | 32 | 33 | 34 | 32 | 30 | 22 | 22 | |
| Steel vol. % | 80 | 79 | 78 | 77 | 80 | 81 | 86 | 86 | 100 |
| W vol. % | 20 | 21 | 22 | 23 | 20 | 19 | 14 | 14 | |

TABLE III

| Club Number | 2 | 3 | 4 | 5 | 6 | 7 | 8 | 9 | P |
|---|---|---|---|---|---|---|---|---|---|
| loft | 17 | 20 | 23 | 26 | 29 | 33 | 37 | 41 | 45 |
| Blade Length (mm) | 77.6 | 77.6 | 77.6 | 77.6 | 77.6 | 77.6 | 77.6 | 77.6 | 77.6 |
| Toe Height (mm) | 51.9 | 52.3 | 52.8 | 53.3 | 53.8 | 54.3 | 54.9 | 55.4 | 55.8 |
| Scoreline Width (mm) | 53.2 | 53.0 | 52.8 | 52.7 | 52.5 | 52.3 | 52.2 | 52 | 51.8 |
| Scoreline to Toe (mm) | 17.3 | 17.5 | 17.7 | 17.8 | 18 | 18.2 | 18.3 | 18.5 | 18.7 |
| Hosel Length (mm) | 62 | 63 | 64 | 65 | 66 | 67 | 68 | 69 | 70 |
| Sole Width (mm) | 19.7 | 19.4 | 19.0 | 18.5 | 18.0 | 17.4 | 16.8 | 16.1 | 15.4 |

Figure 3:
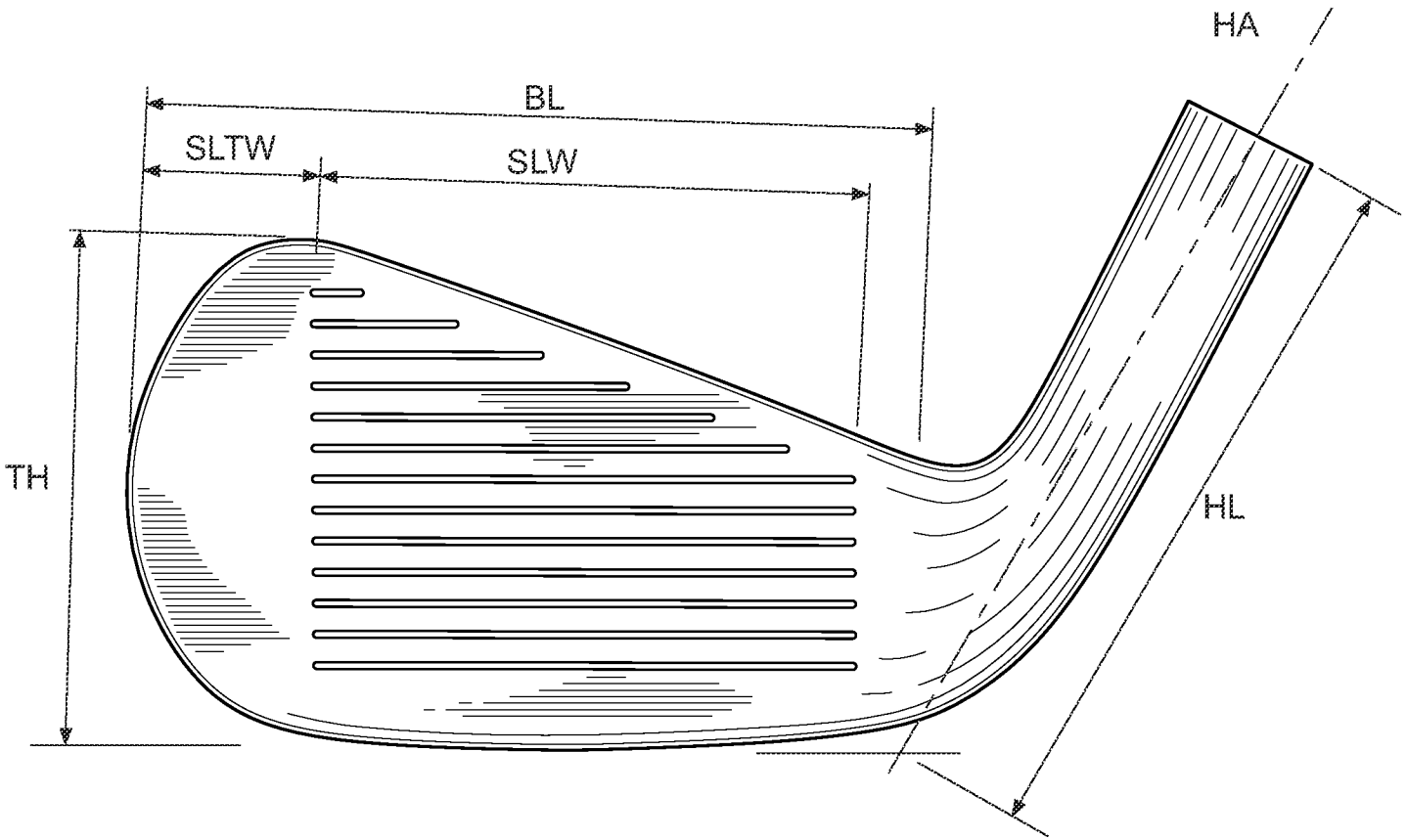
FIG. 3 is a front view of a long iron according to another embodiment of the present invention.

As shown in FIG. 3 and set forth in Table III above, another embodiment of the present invention includes a set of irons that have a substantially constant Blade Length (BL) throughout the set. The BL is defined at the length from the hosel axis (HA) intersection with the ground plane to the end of the toe. However in this set, the Toe Height (TH) progressively increases through the set. Thus, the TH of the mid iron is greater than the TH of the long iron and the TH of the short iron is greater than the TH of the mid iron and the long iron. The TH is defined as the maximum length from the leading edge to the top of the toe in the plane parallel to the face plane and perpendicular to the scorelines. Preferably, the TH increases by about at least 0.3 mm per club, and most preferably at least 0.4 mm per club. Also, the TH preferably increases at least 1 mm per club (or about 4 degrees of loft) for the short irons and only 0.3-0.6 mm per club for the long and mid irons.

Furthermore, even though the BL remains substantially constant through the set, the scoreline width (SLW) progressively decreases through the set and the scoreline to toe width (SLTW) progressively increases through the set. More particularly, the SLW decreases by at least about 0.1 mm per club (or per 4 degrees of loft). Thus, the SLW for the long iron is greater than the SLW for the mid iron and the SLW for the mid iron is greater than the SLW for the short iron. Moreover, because the SLTW progressively increases through the set, the non-grooved toe area increases throughout the set.

Still further, in this preferred embodiment of the present invention, the distance of the center of gravity from the face center progressively increases through the set. Thus, CG-Xfc progressively increases from less than 2 mm from the face center in the long irons to about 3 mm from the face center towards the hosel in the short irons.

Another aspect of the present invention is that the hosel length HL increases through the set. Preferably, the hosel length increases by about 1 mm/club (or per 4 degrees of loft) such that the HL of the mid irons is greater than the HL of the long irons and the HL of the short irons is greater than the HL of the mid irons. Also, the sole width, not shown in the figures because it is the width of the sole at the center of the club head perpendicular to the front view shown in FIG. 3, decreases through the set. Thus, the sole width of the mid irons is less than the sole width of the long irons and greater than the sole width of the short irons. Preferably, the sole width decreases by about 0.3 mm/club (or per 4 degrees of loft).

Figure 4:
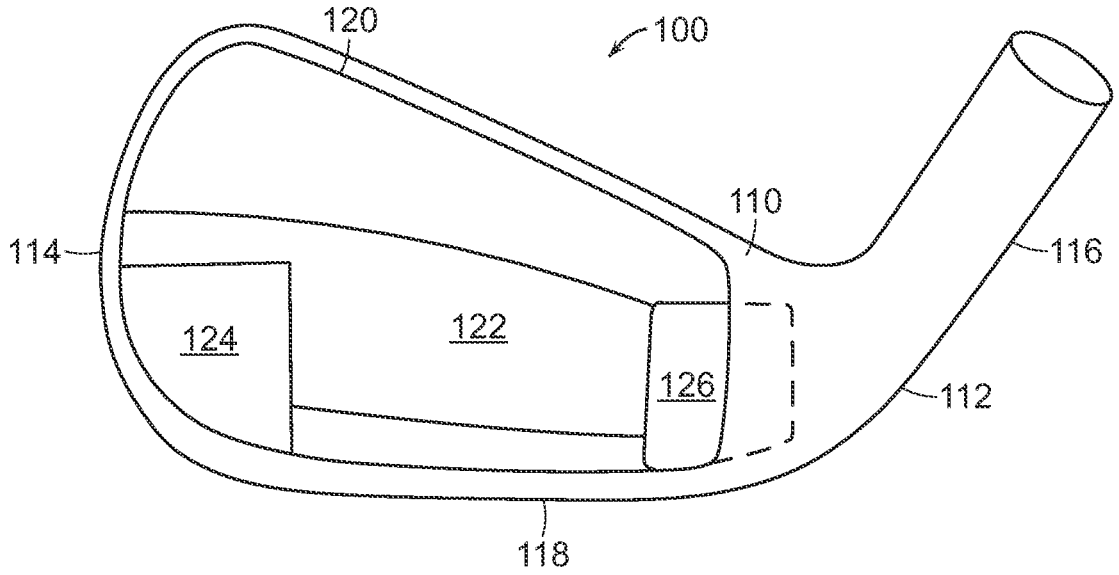
FIG. 4 is a front view of a long iron body member according to the present invention.

As shown in FIGS. 4-7 and set forth in the table above, the set includes a long iron 100, a mid iron 200, a first short iron 300 and a second short iron 400. In FIG. 4, the long iron 100 includes a body member 110, heel 112, a toe 114, a hosel 116 and a sole 118. The iron body 110 includes an insert aperture 120 and a hollow portion 122. A face insert, not shown, is welded to the insert aperture 120 to enclose the hollow portion 122. Both the body member 110 and the face insert are preferably formed of steel. Inside the hollow portion 122, a tungsten toe weight member 124 and a tungsten heel weight member 126 are located proximate the toe 114 and the heel 112, respectively, to create a high moment of inertia. As shown in Table II above, the body member 110 preferably has a mass of about 110 grams to 120 grams and the face insert has a mass of about 30 grams to 45 grams. In the long irons 100, the toe weight member 124 preferably has a mass of about 35 to 55 grams. Preferably, the toe weight member 124 mass increases with each club by about 5 grams per club. The heel weight member 126 is preferably about 30 grams to 35 grams and preferably decreases by about 1 or 2 grams per club. Preferably, the tungsten mass of the toe weight member 124 and the heel weight member 126 are at least 25% of the total club head mass and at least 15% of the total club head solid volume. More particularly, the toe weight member 124 and the heel weight member comprise about 30% of the total mass or more and 20% of the total solid volume. Preferably, the toe weight member 124 has greater mass than the heel weight member 126.

Figure 5:
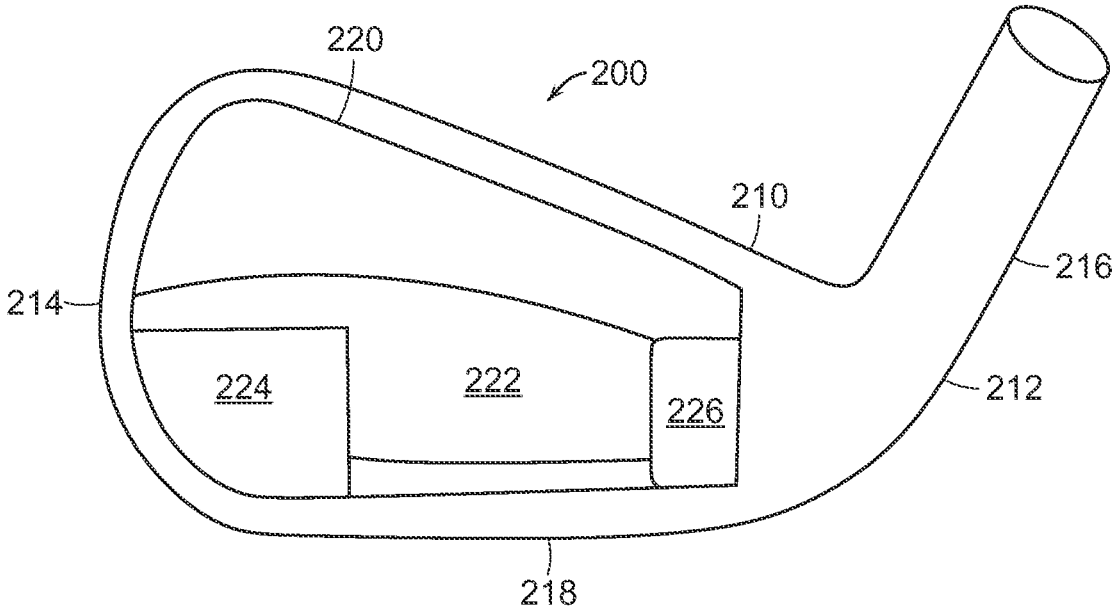
FIG. 5 is a front view of a mid-iron body member according to the present invention.

As shown in FIG. 5 and set forth in Table II above, the set includes a mid iron 200 that includes a body member 210, heel 212, a toe 214, a hosel 216 and a sole 218. The iron body 210 includes an insert aperture 220 and a hollow portion 222. A face insert, not shown, is welded to the insert aperture 220 to enclose the hollow portion 222. Both the body member 210 and the face insert are preferably formed of steel. Inside the hollow portion 222, a tungsten toe weight member 224 and a tungsten heel weight member 226 are located proximate the toe 214 and the heel 212, respectively, to create a high moment of inertia. As shown in Table II above, the body member 210 preferably has a mass of about 115 grams to 145 grams and the face insert has a mass of about 30 grams to 45 grams. In the mid irons 200, the toe weight member 224 preferably has a mass of about 50 to 70 grams. Preferably, the toe weight member 224 mass increases with each club by about 5 grams per club. The heel weight member 226 is preferably about 35 grams or less and preferably decreases per club. Preferably, the tungsten mass of the toe weight member 224 and the heel weight member 226 are at least 25% of the total club head mass and at least 15% of the total club head solid volume. More particularly, the toe weight member 224 and the heel weight member 226 comprise about 30% of the total mass or more and about 20% of the total solid volume. Preferably, the toe weight member 224 has greater mass than the heel weight member 226, and more preferably, is about twice the amount of mass.

Figure 6:
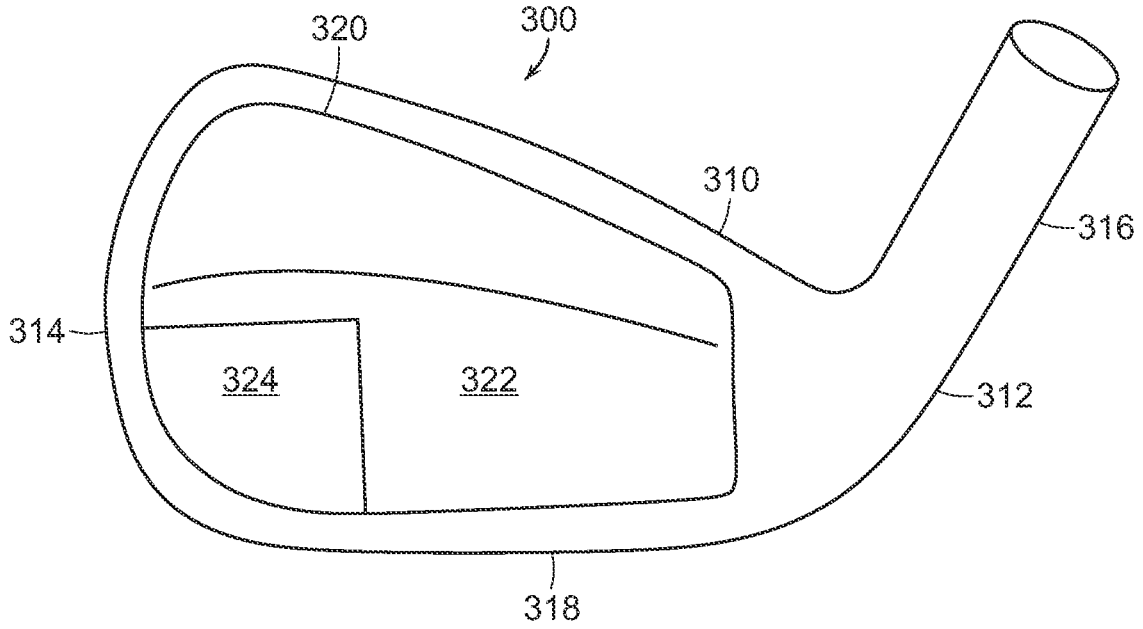
FIG. 6 is a front view of a short iron body member according to the present invention.

As shown in FIG. 6 and as set forth in Table II above, the set can include a short iron 300 that includes a body member 310, heel 312, a toe 314, a hosel 316 and a sole 318. The iron body 310 includes an insert aperture 320 and a hollow portion 322. A face insert, not shown, is welded to the insert aperture 320 to enclose the hollow portion 322. Both the body member 310 and the face insert are preferably formed of steel. Inside the hollow portion 322, a tungsten toe weight member 324 is located proximate the toe 314, to create a high moment of inertia. As shown in Table II above, the body member 310 preferably has a mass of about 150 grams to 200 grams and the face insert has a mass of about 30 grams to 45 grams. In the short iron 300, the toe weight member 324 preferably has a mass of about 55 to 70 grams. Preferably, the tungsten mass of the toe weight member 324 is at least 20% of the total club head mass and at least 10% of the total club head solid volume.

Figure 7:
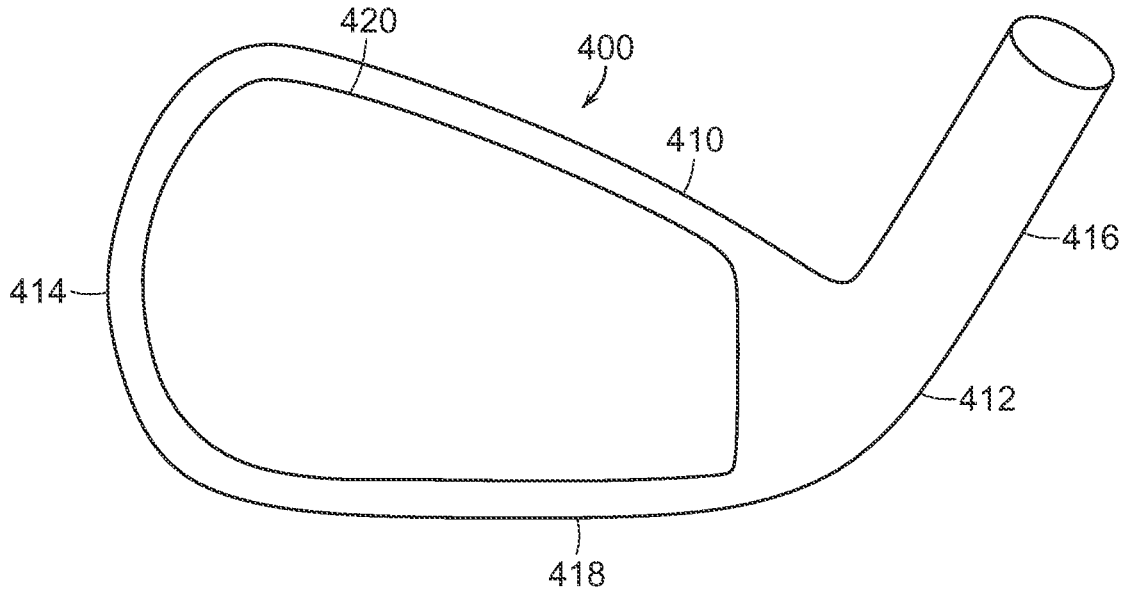
FIG. 7 is a front view of another embodiment of a short iron body member according to the present invention.

As shown in FIG. 7 and as set forth in Table II above, the set can include a short iron 400 that includes a body member 410, heel 412, a toe 414, a hosel 416 and a sole 418. The iron body 410 includes an insert aperture 420. A face insert, not shown, is welded to the insert aperture 420. The short iron 400 is preferably substantially solid and does not contain tungsten weight members.

Referring now to FIGS. 8-19, the present invention also includes a number of ways to attach the tungsten weight to a club head such that the weight and the head can be manufactured and finished separately. Preferably, the club head frame is cast or forged and then polished. The weight can be manufactured out of 17 g/cm3 tungsten and polished. After both components are polished, the weight member can be attached to the body via a mechanical fastener as discussed in more detail below.

Figure 8:
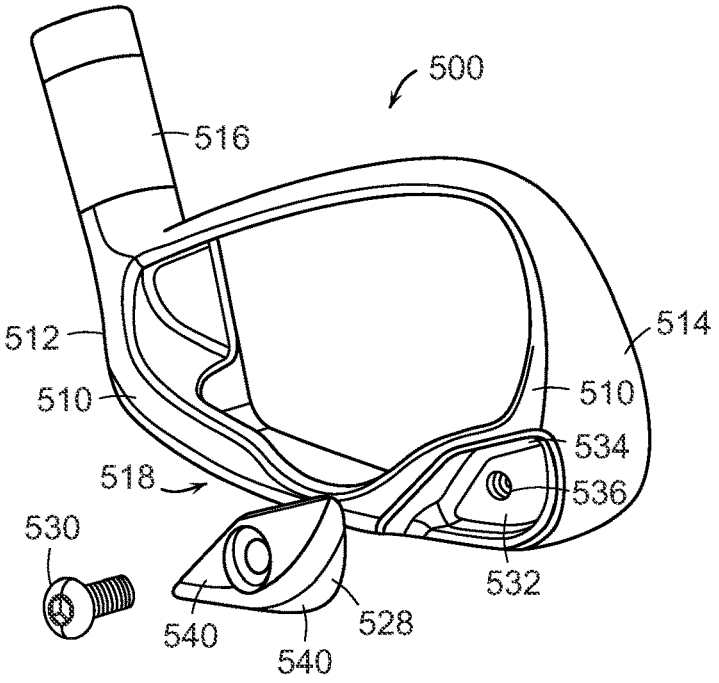
FIG. 8 is an exploded view of an iron according to the present invention.

As shown in FIG. 8, the iron body 500, includes a heel 512, a toe 514, a hosel 516 and a sole 518 and is preferably formed by forging steel or titanium as discussed above. The club head also includes a toe weight member 528 that is coupled to the body 500 by a mechanical fastener 530. The body 500 includes an indentation 532 on the toe 514 and sole 518 for receiving the weight member 528. The indentation 532 includes an inner wall 534 that surrounds a portion of the weight member 528 and a receptacle 536 for coupling with the mechanical fastener 530. In this embodiment, the receptacle 536 is a threaded aperture. As shown in the cross-sectional view of FIG. 9, the wall 534 is formed at an angle $\alpha$ such that the weight member is press fit into the indentation 532 when the mechanical fastener is tightened. Preferably, the angle $\alpha$ is between about 10 degrees and 60 degrees. The weight member 528 and the indentation 532 form a bottom interface 538. In a preferred embodiment, an adhesive tape may be applied at this interface to further secure the weight member 528 to the body 500. The body 500 also includes a back surface 510 and the weight member 528 has an outer surface 540. The outer surface of the weight member 528 preferably creates a lower portion of the toe 514, an outer, toe portion of the sole 518 and a portion of the back surface 510 for maximum MOI efficiency. In the preferred embodiment shown in FIGS. 8 and 9, the body 500 also includes a front surface 542 for welding the front face to, not shown. Further, a paint fill edge 544 can be formed in the weight member 528, the body 500 or both, as shown, to finish the club head and provide a visual separation of the weight member 528.

As discussed above, the toe weight member 528 preferably has a mass of about 35 to 65 grams. Preferably, the toe weight member 528 mass increases with each club by about 5 grams per club through at least a portion of the set. The club can further include a heel weight member that is not shown that is preferably about 30 grams to 35 grams and preferably decreases by about 1 or 2 grams per club through at least a portion of the set. A heel weight can be attached in the same manner as the toe weight member shown or can be placed behind the face insert as discussed above with respect to FIGS. 4 and 5. Preferably, the tungsten mass of the toe weight member 528 and the heel weight member are at least 25% of the total club head mass and at least 15% of the total club head solid volume. As set forth in Table II, and for all the embodiments, the toe weight member is preferably between about 15% and 25% of the total club mass.

Figure 10:
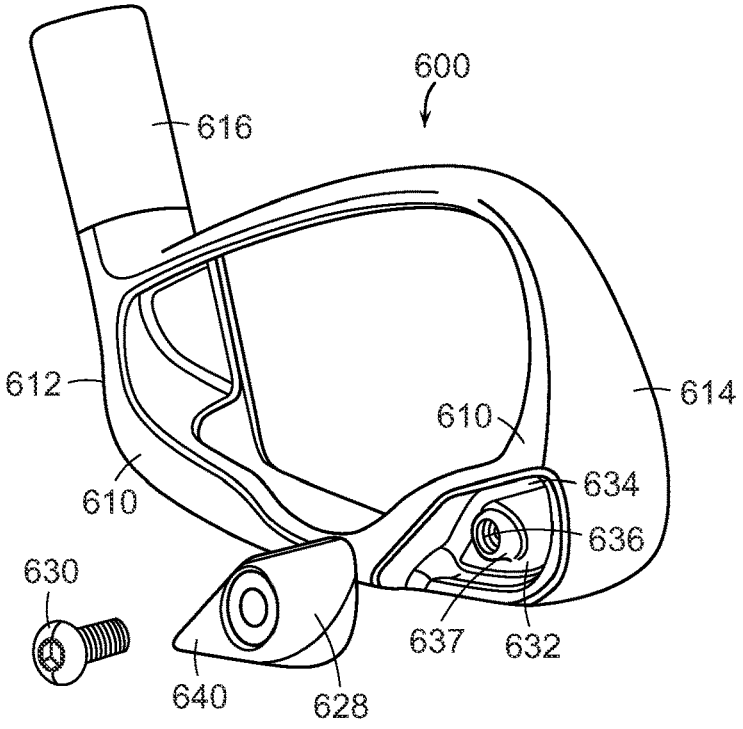
FIG. 10 is an exploded view of an iron according to the present invention.
Figure 11:
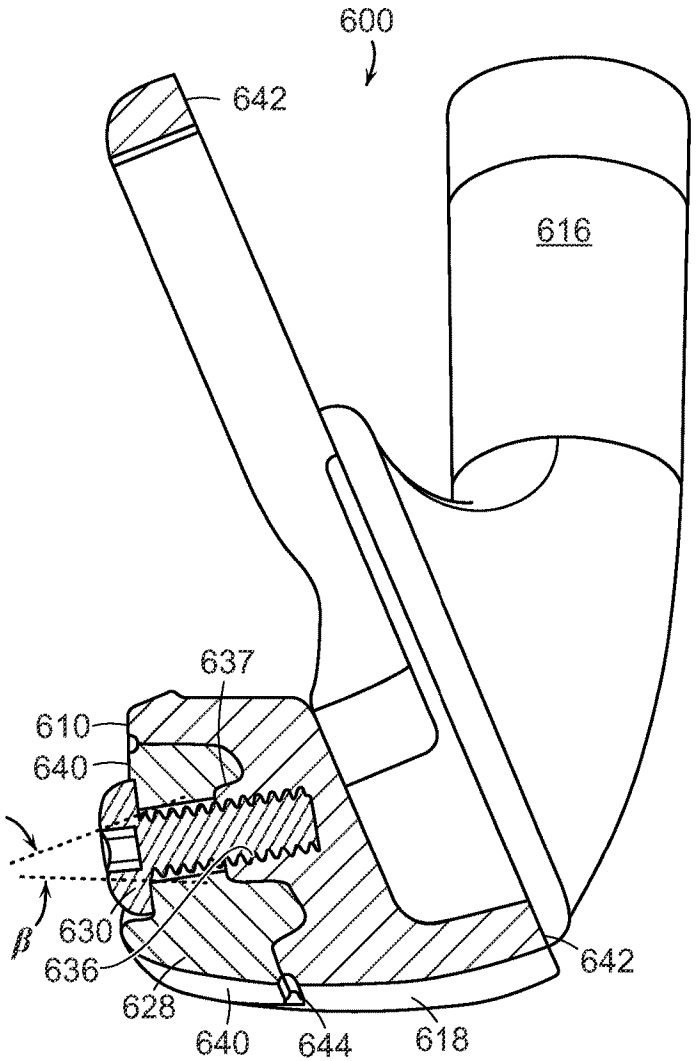
FIG. 11 is a cross-sectional view of the iron in FIG. 10.
Figure 9:
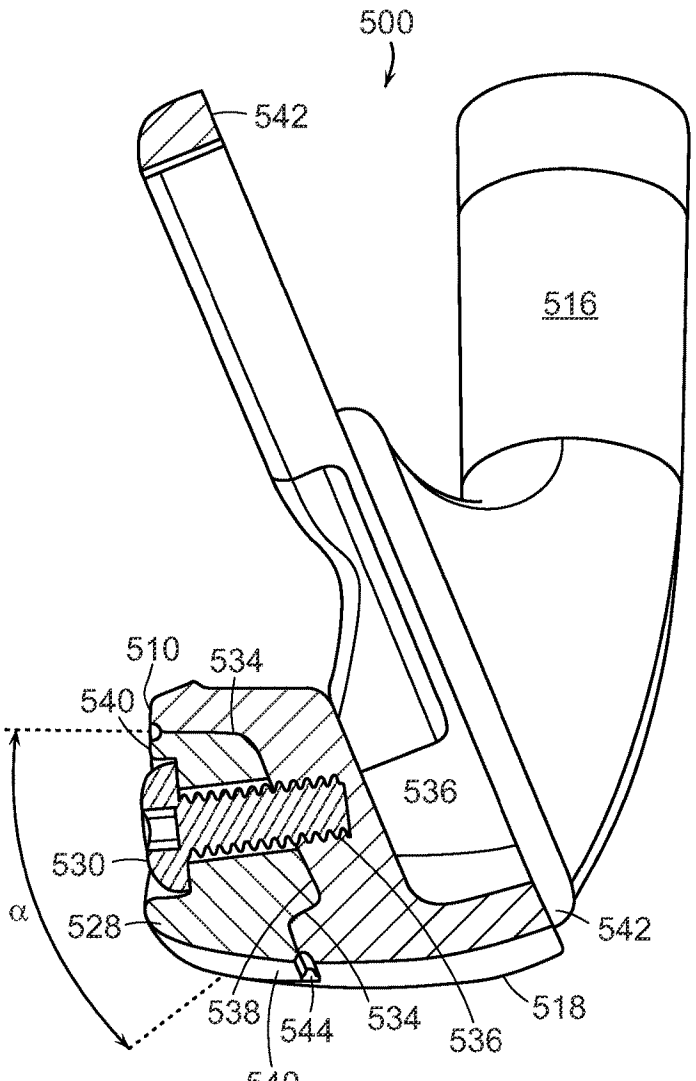
FIG. 9 is a cross-sectional view of the iron in FIG. 8.

As shown in FIG. 10, the iron body 600, includes a heel 612, a toe 614, a hosel 616 and a sole 618 and is preferably formed by forging steel or titanium as discussed above. The club head also includes a toe weight member 628 that is coupled to the body 600 by a mechanical fastener 630. Like the embodiment in FIG. 8, the body 600 includes an indentation 632 on the toe 614 and sole 618 for receiving the weight member 628. The indentation 632 includes an inner wall 634 that surrounds a portion of the weight member 628 and a receptacle 636 for coupling with the mechanical fastener 630. In this embodiment, the indentation 632 further includes a conical collar 637. As shown in the cross-sectional view of FIG. 11, the conical collar 637 is formed at an angle R such that the weight member is press fit into the indentation 632 when the mechanical fastener is tightened. Again, the weight member 628 and the indentation 632 form a bottom interface 638 that can include an adhesive tape juxtaposed the interface to further secure the weight member 628 to the body 600. As above, the outer surface of the weight member 628 preferably creates a lower portion of the toe 614, an outer portion of the sole 618 and a portion of the back surface 610 for maximum MOI efficiency. The body 600 also includes a front surface 642 for welding the front face, not shown, to and a paint fill edge 644 can be formed in the weight member 628, the body 600 or both, as shown, to finish the club head and provide a visual separation of the weight member 628.

Even with the additional conical collar 637, the toe weight member 628 preferably has a mass of about 35 to 55 grams and the toe weight member 628 mass increases with each club by about 5 grams per club. Preferably, the tungsten mass of the toe weight member 628 and any heel weight member are at least 25% of the total club head mass and at least 15% of the total club head solid volume.

Figure 12:
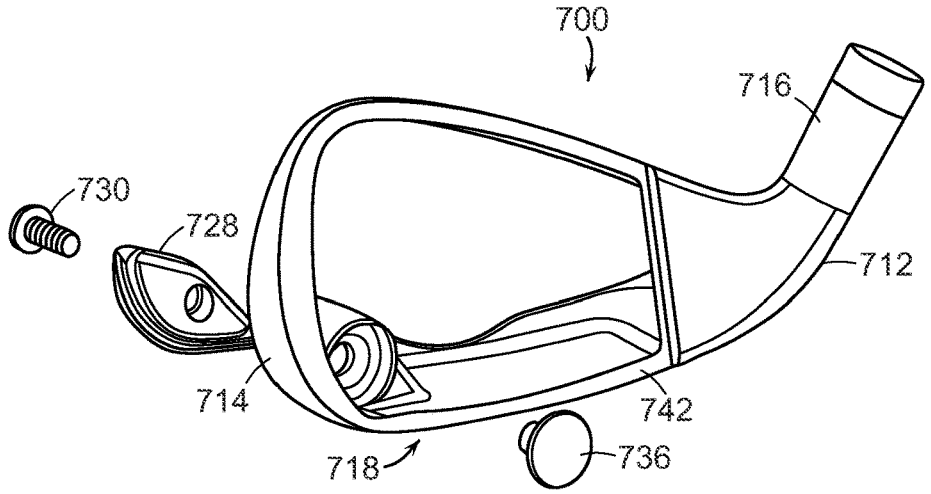
FIG. 12 is an exploded view of an iron according to the present invention.
Figure 13:
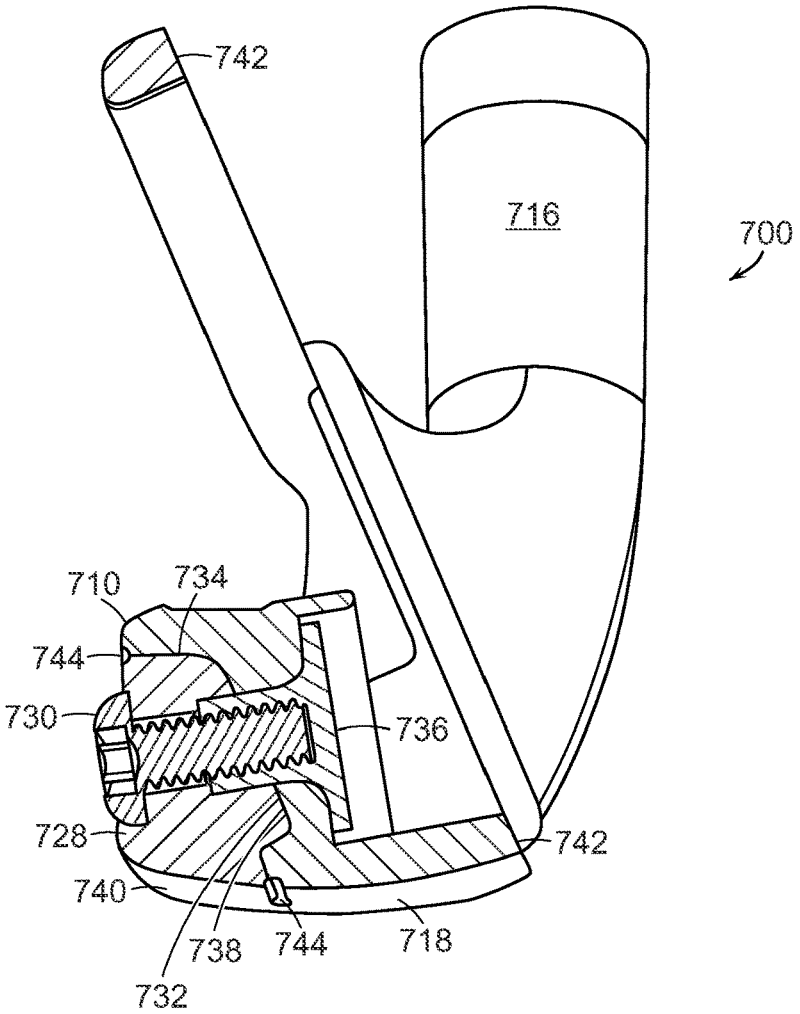
FIG. 13 is a cross-sectional view of the iron in FIG. 12.

FIG. 12 is an exploded view of another embodiment of the present invention. The iron body 700, includes a heel 712, a toe 714, a hosel 716 and a sole 718 and is preferably formed by forging steel or titanium as discussed above. The club head 700 also includes a toe weight member 728 that is coupled to the body 700 by a mechanical fastener 730. Like the embodiment in FIG. 8, the body 700 includes an indentation 732 on the toe 714 and sole 718 for receiving the weight member 728. The indentation 732 includes an inner wall 734 that surrounds a portion of the weight member 728. In this embodiment, as shown in FIG. 13, a threaded receptacle member 736 is inserted into the body 700 through the face side of the body 700 for coupling with the mechanical fastener 730. In this embodiment, the receptacle member 736 is covered from view when the face member, not shown, is welded to the face securing surface 742. As shown in the cross-sectional view of FIG. 13, the fastener 730 and the receptacle member 736 capture the weight member 728 to the body 700. Again, the weight member 728 and the indentation 732 form a bottom interface 738 that can include an adhesive tape juxtaposed the interface to further secure the weight member 728 to the body 700. As above, the outer surface of the weight member 728 preferably creates a lower portion of the toe 714, an outer portion of the sole 718 and a portion of the back surface 710 for maximum MOI efficiency. The body 700 also includes a paint fill edge 744 can be formed in the weight member 728, the body 700 or both, as shown, to finish the club head and provide a visual separation of the weight member 728.

Figure 14:
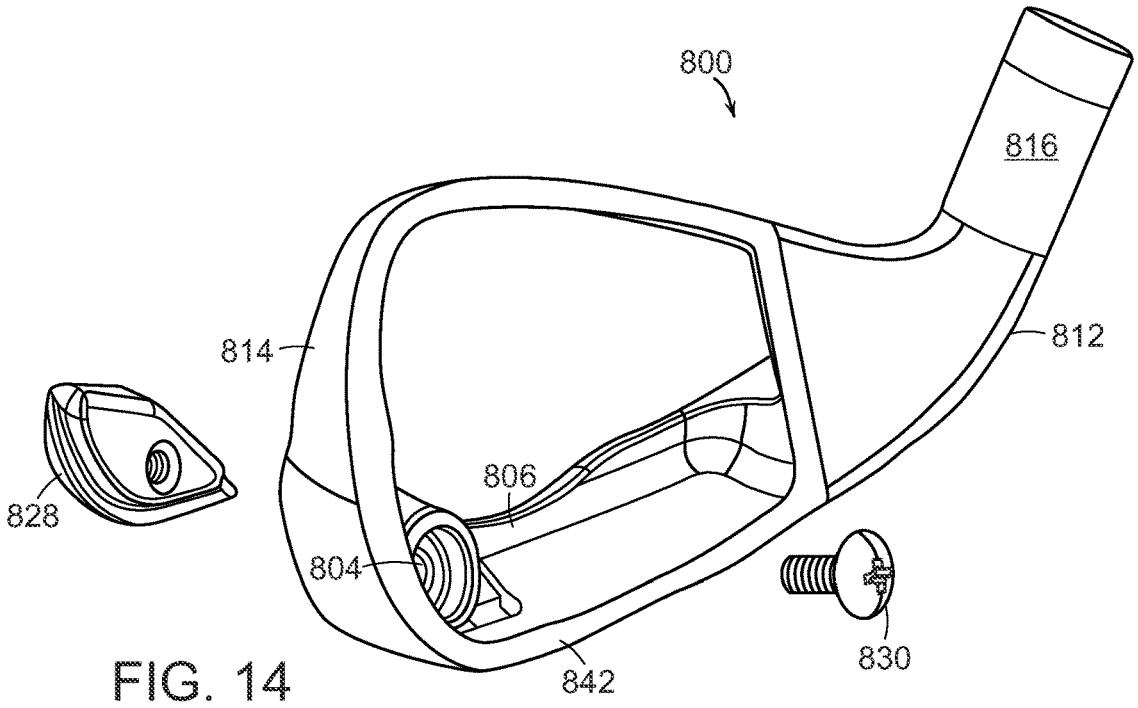
FIG. 14 is an exploded view of an iron according to the present invention.
Figure 15:
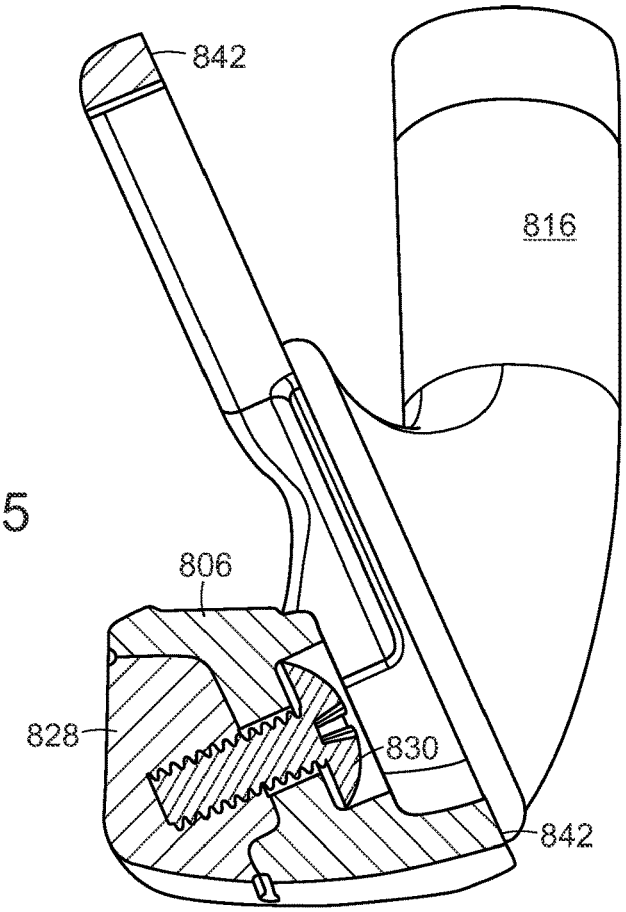
FIG. 15 is a cross-sectional view of the iron in FIG. 14.

Referring to FIGS. 14 and 15, another embodiment of the present invention is an iron body 800 including a heel 812, a toe 814, a hosel 816 and a sole 818. The iron 800 further comprises a toe weight member 828 that is secured to the body 800. In this embodiment, the weight member 828 is secured to the body 800 by a mechanical fastener 830 that is inserted through the face of the iron 800. The iron body 800 can be formed by casting, but is preferably forged. An aperture 804 is formed in the back wall 806 and the weight member 828 is attached to the back wall 806 via the mechanical fastener 830 that is inserted through the face. Then, a face member can be welded to the face retaining surface 842.

As in the other embodiments, the toe weight member 828 preferably has a mass of about 35 to 55 grams. Preferably, the toe weight member 828 mass increases with each club by about 5 grams per club. The club can further include a heel weight member that is not shown that is preferably about 30 grams to 35 grams and preferably decreases by about 1 or 2 grams per club. A heel weight can be attached in the same manner as the toe weight member shown or can be placed behind the face insert as discussed above with respect to FIGS. 4 and 5. Preferably, the tungsten mass of the toe weight member 828 and the heel weight member are at least 25% of the total club head mass and at least 15% of the total club head solid volume. In yet another embodiment, the body 800 can include a hosel weight instead of a heel weight to further increase the MOI about the horizontal axis.

Figure 16:
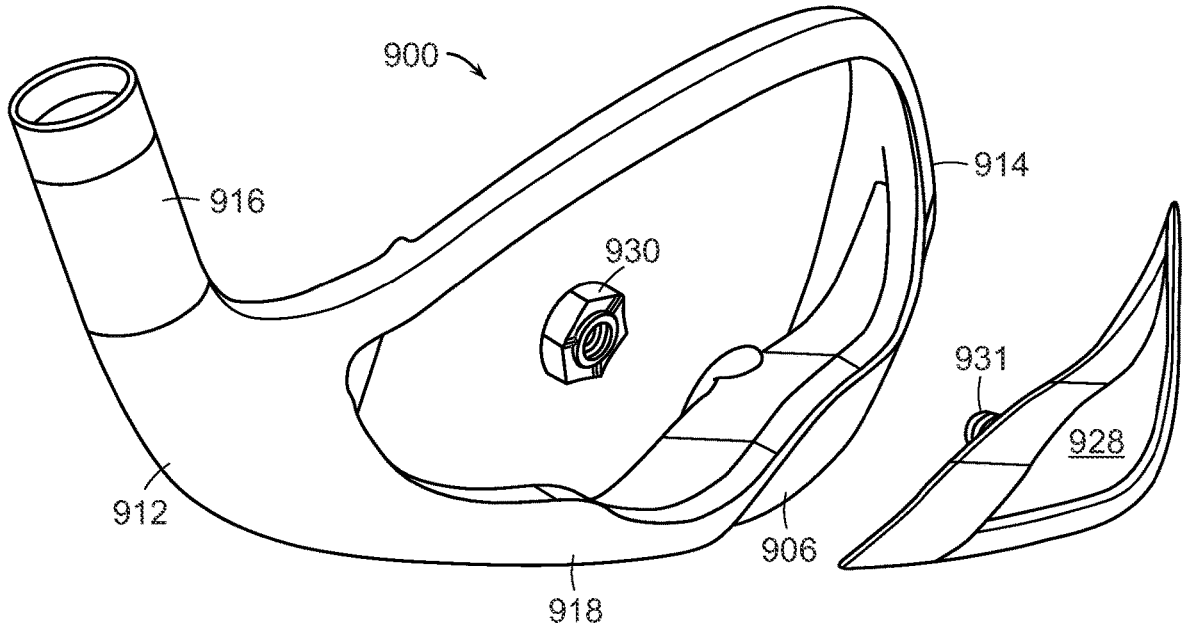
FIG. 16 is an exploded view of an iron according to the present invention.

Referring to FIG. 16, another embodiment of the present invention is an iron body 900 including a heel 912, a toe 914, a hosel 916 and a sole 918. The iron 900 further comprises a toe weight member 928 that is coupled to the body 900. In this embodiment, the weight member 928 is coupled to the body 900 by a mechanical fastener 930 that is nut fastener inserted through the face of the iron 900 that tightens onto a threaded portion 931 of the weight member 928. The iron body 900 can be formed by casting, but is preferably forged. An aperture is formed in the back wall 906 and the weight member 928 is attached to the back wall 906 via the mechanical fastener 930 that is inserted through the face. Then, a face member can be welded to the face retaining surface.

Figure 17:
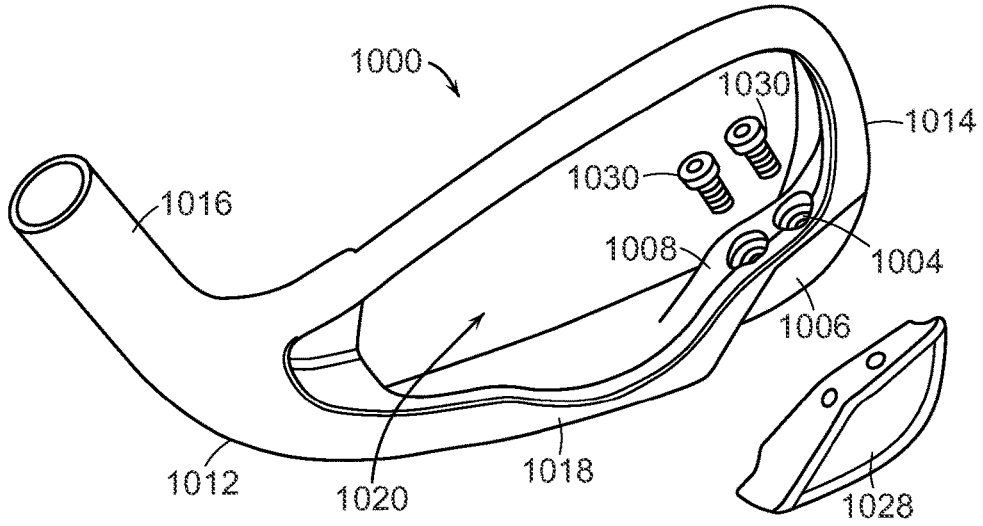
FIG. 17 is an exploded view of an iron according to the present invention.

Referring to FIG. 17, another embodiment of the present invention is an iron body 1000 including a heel 1012, a toe 1014, a hosel 1016 and a sole 1018. The iron 1000 further comprises a toe weight member 1028 that is coupled to the body 1000. In this embodiment, the weight member 1028 is coupled to the back surface 1006 of the body 1000 by a plurality of mechanical fasteners 1030 that are inserted through the back cavity 1020 of the iron 1000. More particularly, a plurality of apertures 1004 can be formed in a bottom surface 1008 of the back cavity 1020 such that the threaded fasteners 1030 can couple to the weight member 1028. The iron body 1000 can be formed by casting, but is preferably forged. As shown, a face member can be welded to the face retaining surface, but this embodiment can also allow for the face to be integrally formed with the body 1000.

Figure 18:
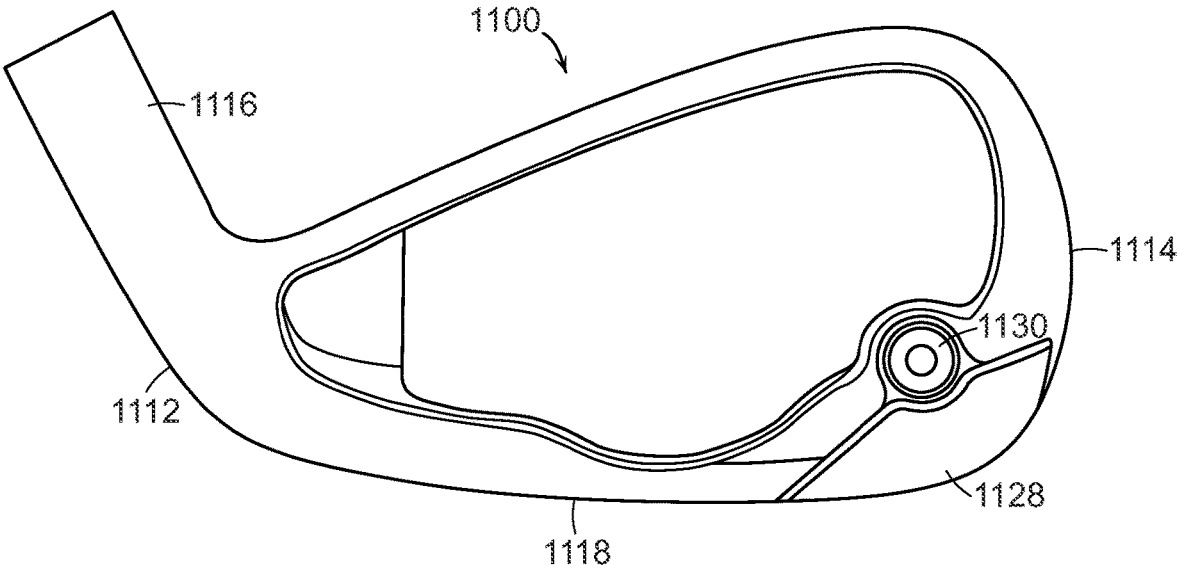
FIG. 18 is a back view of an iron according to the present invention.
Figure 19:
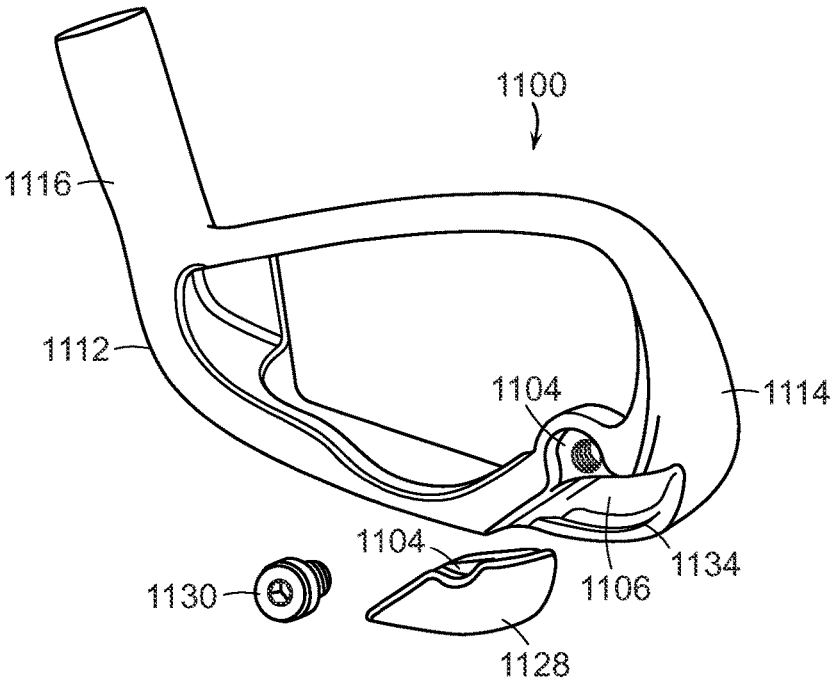
FIG. 19 is an exploded view of the iron in FIG. 18.

Referring to FIGS. 18 and 19, another embodiment of the present invention is an iron body 1100 including a heel 1112, a toe 1114, a hosel 1116 and a sole 1118. The iron 1100 further comprises a toe weight member 1128 that is coupled to the body 1100. In this embodiment, the weight member 1128 is coupled to the body 1100 by a mechanical fastener 1130 that provides an abutting lock. More particularly, a recess 1104 is formed in an outer surface 1108 of the iron body 1100 and the weight member 1128 such that the head of the threaded fastener 1030 can couple the weight member 1128 to the back surface 1106 of the body 1100. A retaining wall 1134 surrounds the weight member 1128 such that the weight member 1128 is press fit when the fastener member 1130 is secured in the recess 1104. The iron body 1100 can be formed by casting, but is preferably forged. As shown, a face member can be welded to the face retaining surface, but this embodiment can also allow for the face to be integrally formed with the body 1100.

Figure 20:
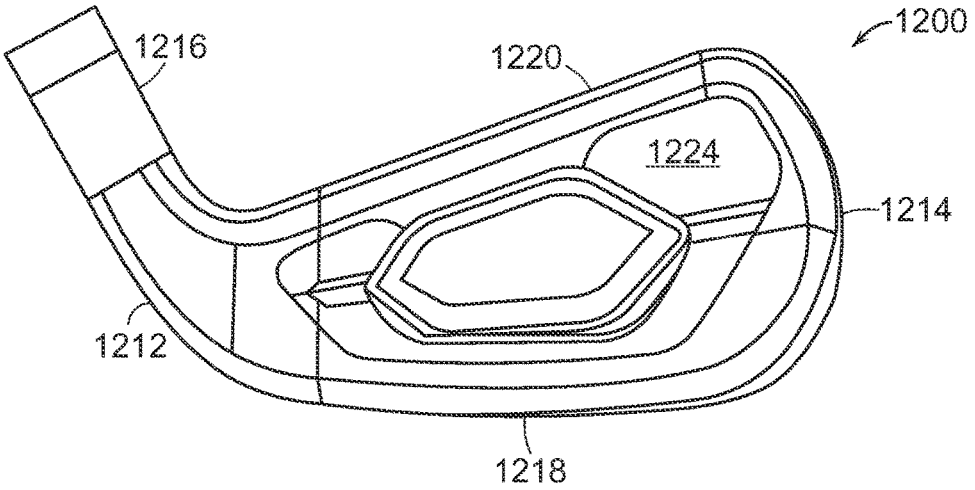
FIG. 20 is a back view of an iron according to the present invention.
Figure 21:
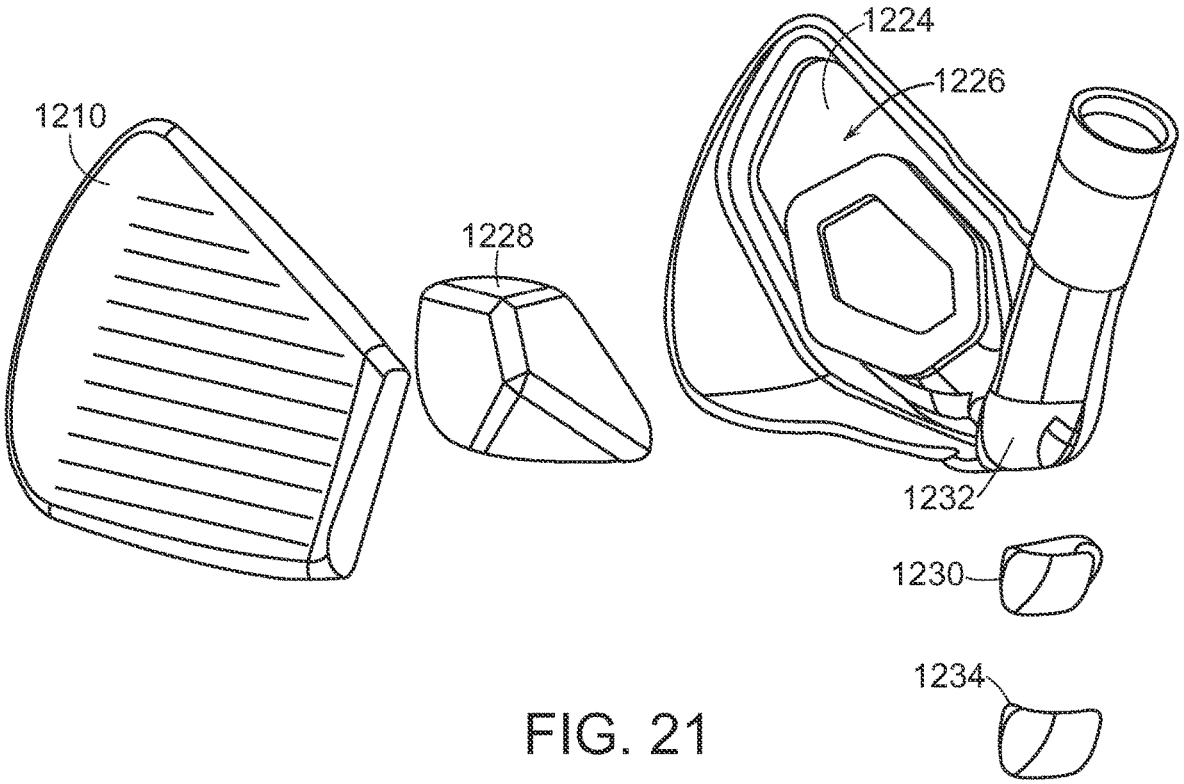
FIG. 21 is an exploded view of the iron in FIG. 20.
Figure 22:
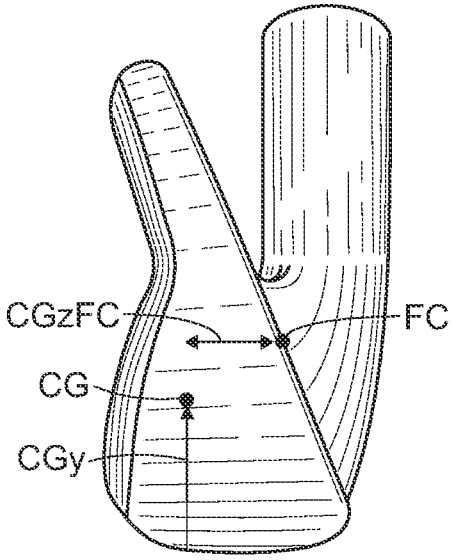
FIG. 22 is a side view of the iron in FIGS. 20 and 21.

Referring to FIGS. 20, 21 and 22, another embodiment of the present invention is a set of golf clubs comprising at least a long iron having a loft between about 15 and 25 degrees and a first club head mass, a mid iron having a loft of between about 26 and 35 degrees and a second club head mass, and a short iron having a loft of about 36 degrees or greater and a third club head mass. The long iron, for example, comprises a steel body 1200 that comprises a heel 1212, a toe 1214, a topline 1220, a sole 1218, and a hosel 1216. A front face insert 1210 and a back wall 1224 form a hollow cavity 1226 therebetween.

Preferably, the iron body is cast with the main cavity 1226 and the hosel cavity 1232. The front face insert 1210 is preferably stamped from a high strength sheet metal and is welded to the body after a toe weight member 1228 is secured with in the hollow cavity 1226. A heel weight member 1230 is inserted into the face side of the hosel cavity 1232 and then a hosel cover member 1234 is welded to the front portion of the hosel 1216 to secure the heel weight member 1230 within the hosel cavity 1232.

The toe weight member 1228 is formed of tungsten and is coupled to a toe portion of the hollow cavity 1226. Preferably, as set forth in Table IV below, the toe weight member 1228 is greater than about 65 grams and comprises about 25%-35% of the long iron club head mass. The long iron head further comprises the heel weight member 1230, also formed of tungsten, that is about 10 to 20 grams and is coupled into the hosel cavity 1232 formed in the front, lower portion of the hosel 1216. Preferably, the heel weight member 1230 comprises about 5%-10% of the long iron head mass. In this embodiment, the heel weight member 1230 is preferably secured in the hosel cavity 1232 by a steel cover member 1234 that forms at least a front portion of the hosel 1216.

In the preferred set, the mid iron has the same or similar construction as the long iron, and thus, similarly comprises a steel, hollow body with a heel, a toe, a topline, a sole, and a hosel. As set forth in Table IV below, the toe weight member for at least one of the mid irons is also formed of greater than 65 grams of tungsten and comprises about 25%-35% of the mid iron head mass.

The club heads according to the present invention have high Moment of Inertias. Because they have such large tungsten weight members, the Moment of Inertia about the y-axis (34 shown in FIG. 2), MOIy, is greater than 250 kg-mm$^2$ for all of the irons. Still further, the irons in the preferred set as presented in Tables IV and V below are not oversized. That is, the blade length is less than 82 mm. Thus, the MOIy to blade length ratio is very high. More particularly, the MOIy to blade length ration is greater than 3 kg-mm, and more preferably, between about 3.1 kg-mm and 3.5 kg-mm.

Moreover, because the mid irons and the long irons are hollow, the Center of Gravity is relatively deep. More particularly, the Center of Gravity depth from the face center, CGzFC, is preferably greater than 6 mm for all of the irons. In a preferred embodiment, the CGzFC can be around 8 mm for the long irons. Preferably, the CGzFC is almost 1/10 of the blade length for the long irons.

Also, the Center of Gravity from the ground, CGy, is very low through the set. As set forth in Table V below, preferably, the CGy is less than 18 mm from a ground surface for the long irons and less than 19 mm for the mid irons and short irons when the club head is in the standard address position.

TABLE IV

| Club Number | 3 | 4 | 5 | 6 | 7 | 8 | 9 | P |
|---|---|---|---|---|---|---|---|---|
| loft | 19 | 22 | 25 | 28 | 31 | 35 | 39 | 43 |
| Total Mass (g) | 239 | 247 | 254 | 261 | 268 | 274 | 284 | 286 |
| Body Mass (g) | 85 | 86 | 87 | 118 | 261 | 267 | 278 | 280 |
| Face Mass (g) | 58 | 58 | 58 | 56 | | | | |
| Toe W (g) | 67 | 74 | 77 | 73 | | | | |
| Heel W (g) | 14 | 15 | 18 | | | | | |
| Steel Mass % | 60 | 58 | 57 | 67 | | | | |
| W Mass % | 34 | 36 | 37 | 28 | | | | |

TABLE V

| Club Number | 3 | 4 | 5 | 6 | 7 | 8 | 9 | P |
|---|---|---|---|---|---|---|---|---|
| Blade Length (mm) | 81 | 81 | 81 | 80 | 80 | 80 | 80 | 80 |
| Toe Height (mm) | 31 | 31.5 | 32 | 32.3 | 32.7 | 33.3 | 34 | 34.5 |
| Scoreline Width (mm) | 54.5 | 54.3 | 54.1 | 54 | 53.8 | 53.6 | 53.3 | 53.1 |
| Sole Width Center (mm) | 16.8 | 16.3 | 15.8 | 15.3 | 14.8 | 14.65 | 14.5 | 14.35 |
| CGy (mm) | 17.75 | 17.8 | 17.9 | 18 | 18.4 | 18.6 | 18.7 | 18.7 |
| MOIy (kg-mm$^2$) | 257 | 259 | 266 | 261 | 260 | 262 | 267 | 274 |

Figure 23:
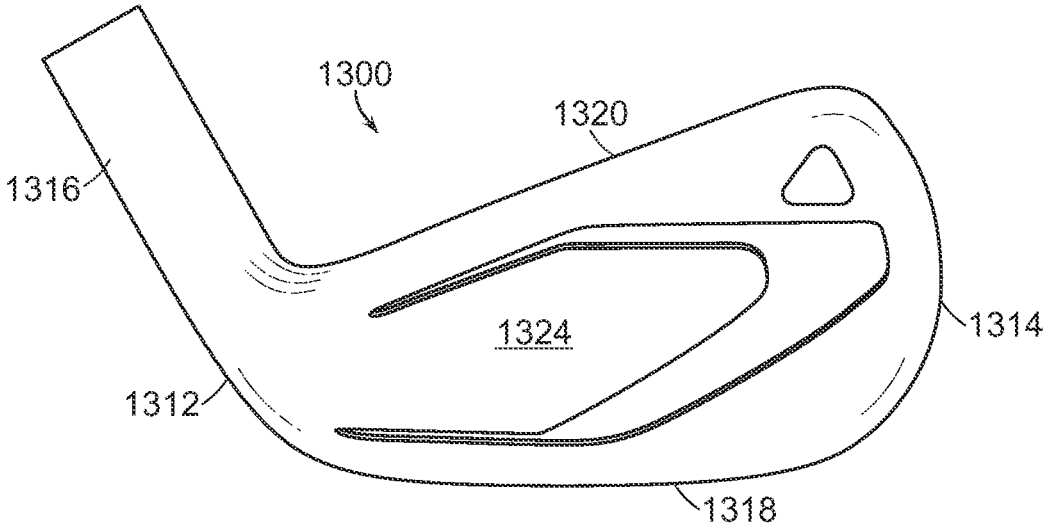
FIG. 23 is a back view of an iron according to the present invention.
Figure 24:
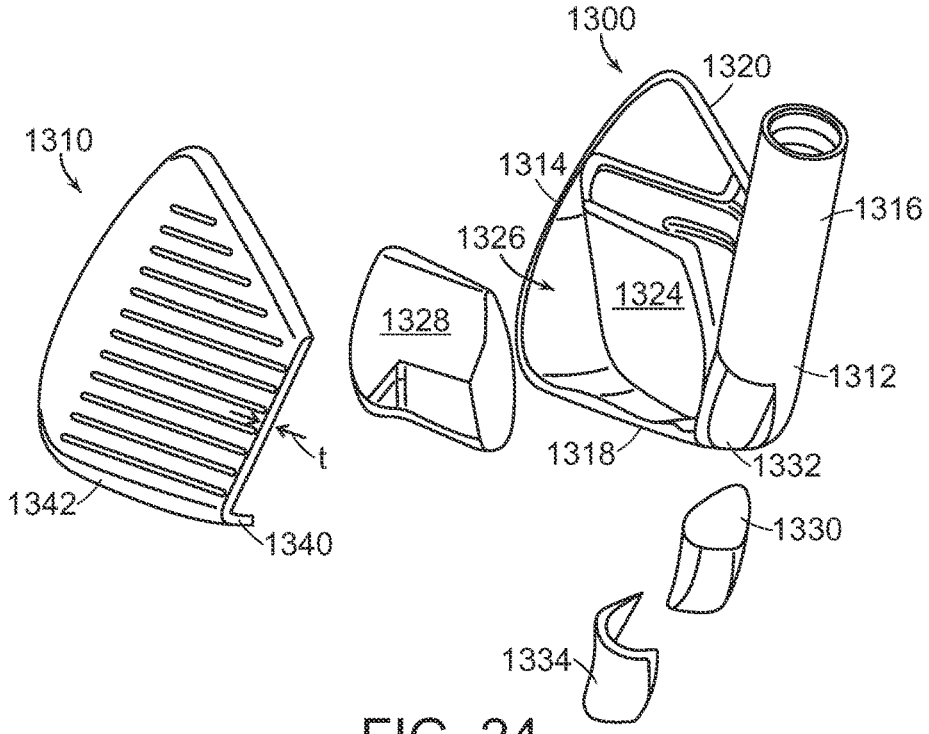
FIG. 24 is an exploded view of the iron in FIG. 23 from a heel perspective.
Figure 25:
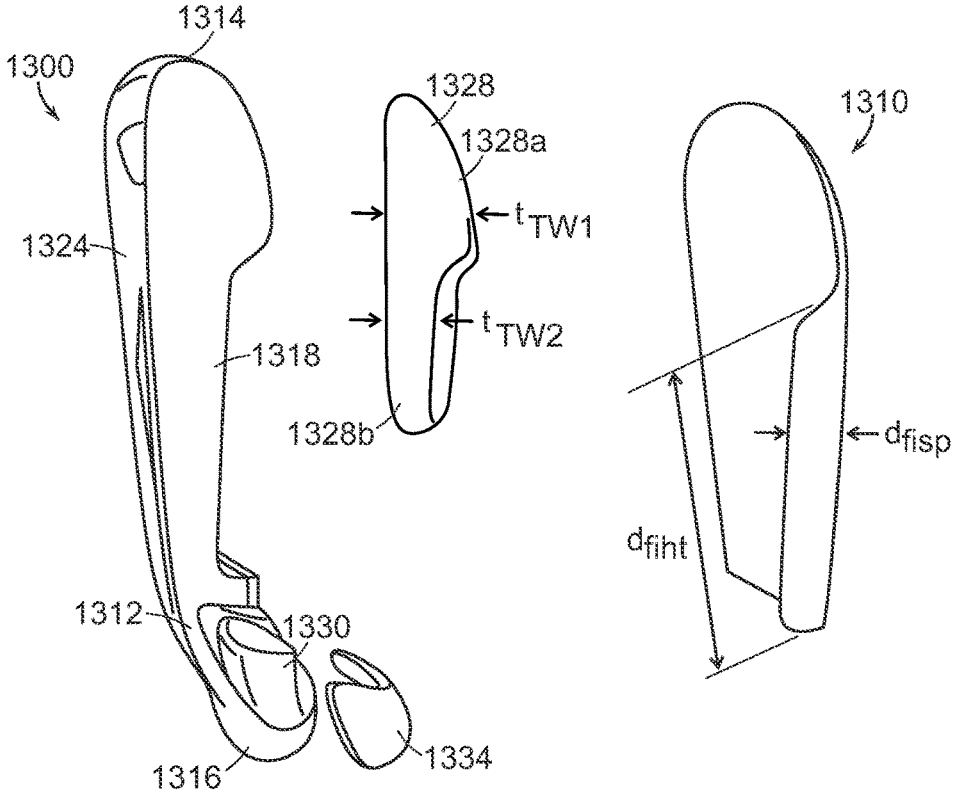
FIG. 25 is an exploded view of the iron in FIG. 23 from a sole perspective.

Referring to FIGS. 23 through 25, another embodiment of the present invention is a set of golf clubs comprising at least a long iron having a loft between about 15 and 25 degrees and a first club head mass, a mid iron having a loft of between about 26 and 35 degrees and a second club head mass, and a short iron having a loft of about 36 degrees or greater and a third club head mass. The long iron, preferably, comprises a steel body 1300 that comprises a heel 1312, a toe 1314, a topline 1320, a sole 1318, and a hosel 1316. A front face insert 1310 and a back wall 1324 form a hollow cavity 1326 therebetween.

Preferably, the iron body is cast to form the hollow cavity 1326 and a hosel cavity 1332. The front face insert 1310 is preferably stamped from a high strength sheet metal and is welded to the body after a toe weight member 1328 is secured with in the hollow cavity 1326. As shown in the Tables II and IV above and Table VI below, it is important for the face member to be light weight to create a high MOI. Preferably, the face member 1310 has a mass of less than 45 grams, and more preferably, has less mass that the toe weight member 1328. It is even more preferred that the face insert mass is less than ½ the mass of the toe weight member 1328. In a preferred embodiment, the face member 1310 is formed from steel having an Ultimate Tensile Strength of greater than 2000 MPa. In the most preferred embodiment, the face insert 1310 is formed to a thickness t of 1.8 mm or less and has an Ultimate Tensile Strength of 2300 MPa or greater. In one embodiment, the long irons can be formed with a face insert 1310 stamped from AerMet 340 with the face insert 1310 having a thickness t of about 1.75 mm or less when measure at the center of the face. The face insert 1310 preferably has a uniform thickness, but may have a thinner perimeter region surrounding a thicker center with a smooth transition zone connecting the center to the perimeter. In this embodiment, the center section is at least 10% thicker than the perimeter region. The face insert material for either embodiment preferably has a Fatigue Strength of greater than 800 MPa, and more preferably, greater than about 900 MPa, which is extremely important for the durability of the iron.

A heel weight member 1330 is inserted into the face side of the hosel cavity 1332 and then a hosel cover member 1334 is welded to the front portion of the hosel 1316 to secure the heel weight member 1330 within the hosel cavity 1332. The toe weight member 1328 is formed of tungsten and is coupled to a toe portion of the hollow cavity 1326. Preferably, as set forth in Table VI below, the toe weight member 1328 is greater than about 65 grams and comprises about 25%-40% of the long iron club head mass. The long iron head further comprises the heel weight member 1330, also formed of tungsten, that is about 10 to 25 grams and is coupled into the hosel cavity 1332 formed in the front, lower portion of the hosel 1316. Preferably, the heel weight member 1330 comprises about 5%-10% of the long iron head mass and the mass increases with loft through the set. In this embodiment, the heel weight member 1330 is preferably secured in the hosel cavity 1332 by a steel cover member 1334 that forms at least a front, lower portion of the hosel 1316.

As shown in FIG. 24, the face insert 1310 includes a face insert sole portion 1340 that extends from the leading edge 1342 toward the back wall 1324. Preferably, the face insert sole portion 1340 extends in the front-to-back direction from the leading edge 1342 a distance $d_{fisp}$ that is at least 25% or the sole width distance. Moreover, it is preferred that the face insert sole portion 1340 extends from the heel 1312 toward the toe 1314. Preferably, the face insert sole portion 1340 has a length $d_{fiht}$ in the heel-to-toe direction that is between 50% and 80% of the blade length. This enables the face insert 1310 to form a majority of the front portion of the sole, but allows the body portion of the sole 1318 to hold the toe weight member 1328.

The toe weight member 1328 can also be formed of two portions, the toe extremity portion 1328*a* and the toe central portion 1328*b*. In order to maximize the MOI of the iron, it is preferred that the toe extremity portion 1328*a* has a first width $t_{tw1}$ and the toe central portion 1328*b* has a second width $t_{tw2}$ that is less than the first width. More preferably, the first width $t_{tw1}$ is at least 50% greater than the second width $t_{tw2}$.

In the preferred set, the mid iron has the same or similar construction as the long iron, and thus, similarly comprises a steel, hollow body with a heel, a toe, a topline, a sole, and a hosel. As set forth in Table VI below, the toe weight member for at least one of the mid irons is also formed of greater than 65 grams of tungsten, and more preferably greater than 90 grams of tungsten. The toe weight member 1328 for the mid iron preferably comprises about 25%-40% of the mid iron head mass.

The club heads according to the present invention have high Moment of Inertias. Because they have such large tungsten weight members, the Moment of Inertia about the y-axis (34 shown in FIG. 2), MOIy, is greater than 230 kg-mm$^2$ for all of the irons. Still further, the irons in the preferred set as presented in Tables VI and VII below have small blade lengths, that is less than 82 mm and more preferably less than 78 mm. Thus, the MOIy to blade length ratio is very high. More particularly, the MOIy to blade length ration is greater than about 3 kg-mm, and more preferably, between about 3.0 kg-mm and 3.5 kg-mm.

Moreover, because the mid irons and the long irons are hollow, the Center of Gravity is relatively deep. More particularly, the Center of Gravity depth from the face center toward the back wall 1324, CGz, is preferably greater than 6 mm for all of the irons. In a preferred embodiment, the CGz can be between 6 mm and 6.5 mm through the set. Preferably, the CGz is almost 1/10 of the blade length for the long irons.

Also, the Center of Gravity from the ground, CGy, is very low through the set. As set forth in Table V below, preferably, the CGy is less than about 18 mm from a ground surface for the long irons and less than about 19 mm for the mid irons and greater than about 19 mm for the short irons when the club head is in the standard address position.

TABLE VI

| Club Number | 3 | 4 | 5 | 6 | 7 | 8 | 9 | P |
|---|---|---|---|---|---|---|---|---|
| loft | 20 | 23 | 26 | 29 | 32 | 36 | 40 | 44 |
| Total Mass (g) | 239 | 245 | 251 | 258 | 265 | 274 | 281 | 286 |
| Body Mass (g) | 89 | 89 | 93 | 94 | 94 | 117 | 281 | 286 |
| Face Mass (g) | 42 | 42 | 42 | 43 | 44 | 41 | | |
| Toe W (g) | 88 | 87 | 93 | 91 | 97 | 83 | | |
| Heel W (g) | 17 | 23 | 20 | 25 | 27 | 28 | | |
| Steel Mass % | 55 | 53 | 54 | 53 | 52 | 58 | 100 | 100 |
| W Mass % | 44 | 45 | 45 | 45 | 47 | 41 | | |

TABLE VII

| Club Number | 3 | 4 | 5 | 6 | 7 | 8 | 9 | P |
|---|---|---|---|---|---|---|---|---|
| Blade Length (mm) | 76 | 76 | 76 | 76 | 75 | 75 | 75 | 75 |
| Toe Height (mm) | 51 | 51 | 51 | 53 | 53 | 53 | 55 | 56 |
| Scoreline Width (mm) | 53 | 53 | 52 | 52 | 52 | 52 | 52 | 51 |
| Sole Width Center (mm) | 17 | 17 | 16 | 16 | 16 | 15 | 15 | 15 |
| CGy (mm) | 18.1 | 18.2 | 18.4 | 18.5 | 18.6 | 18.9 | 19.4 | 19.2 |
| CGz (mm) | 6.4 | 6.3 | 6.3 | 6.2 | 6.15 | 6.05 | 6.35 | 6.35 |
| MOIy (kg-mm$^2$) | 231 | 237 | 230 | 236 | 240 | 249 | 232 | 239 |

Referring to FIGS. 26 through 29 and Tables VIII and IX below, another embodiment of the present invention is a set of golf clubs comprising at least a long iron having a loft between about 15 and 25 degrees and a first club head mass, a mid iron having a loft of between about 26 and 35 degrees and a second club head mass, and a short iron having a loft of about 36 degrees or greater and a third club head mass. The long iron, preferably, comprises a steel body 1400 that comprises a heel 1412, a toe 1414, a topline 1420, a sole 1418, and a hosel 1416. A front face insert 1410 and a back wall 1424 form a hollow cavity 1426 therebetween and a medallion 1444 is secured to the outer surface of the back wall 1424. In a preferred embodiment, the medallion 1444 can also cover one or more apertures 1446 in the back wall 1424.

Preferably, the iron body 1400 of at least the long iron is cast to form the hollow cavity 1426 and a hosel cavity 1432 located below the hosel 1416. The front face insert 1410 is preferably stamped from a high strength sheet metal and is welded to the body after a toe weight member 1428 is secured within the hollow cavity 1426 and a heel weight member 1430 is secured in the hosel cavity 1432. As shown in the Tables II, IV and VI above and Table VIII below, it is important for the face member to be light weight to create a high MOIy. Preferably, the face member 1410 has a mass of less than 55 grams, and more preferably, has less mass that the toe weight member 1428. In a preferred embodiment, the face member 1410 is formed from steel having an Ultimate Tensile Strength of greater than 2000 MPa. In the most preferred embodiment, the face insert 1410 is formed to a thickness t of 1.8 mm or less and has an Ultimate Tensile Strength of 2300 MPa or greater. In one embodiment, the long irons and mid irons can be formed with a face insert 1410 stamped from AerMet 340 with the face insert 1410 having a thickness t of about 1.8 mm or less when measure at the center of the face and the short irons can be formed with a face insert 1410 having a thickness t of 2.0 mm or less. The face insert 1410 preferably has a uniform thickness, but may have a thinner perimeter region surrounding a thicker center with a smooth transition zone connecting the center to the perimeter. In this embodiment, the center section is at least 10% thicker than the perimeter region. The face insert material for either embodiment preferably has a Fatigue Strength of greater than 800 MPa, and more preferably, greater than about 900 MPa, which is important for the durability of the iron.

Figure 27:
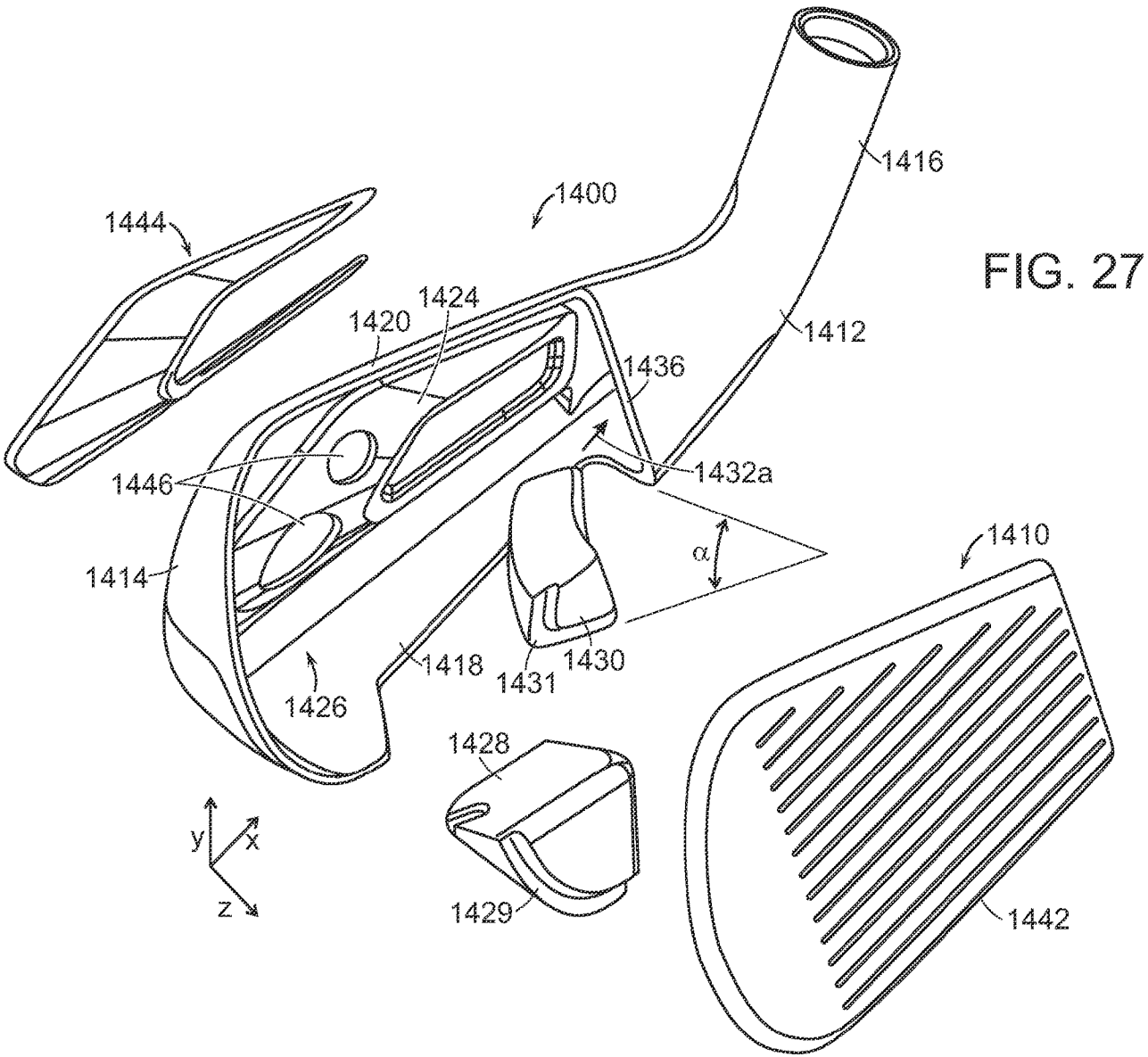
FIG. 27 is an exploded view of the iron in FIG. 26 from a toe perspective.

As stated above, the heel weight member 1430 is inserted into the hosel cavity 1432 which is cast into the lower portion of the hosel 1416. In FIG. 27, the arrow 1432*a* points to the hosel cavity 1432, which is located under the hosel 1416. The heel weight member 1430 is formed from tungsten having a specific gravity of about 15-20 g/cm$^3$ and is an arcuate weight member having an arc angle $\alpha$ of about 5 degrees to about 60 degrees. More preferably, the heel weight member has an arc angle $\alpha$ of about 20 degrees to about 45 degrees. The heel weight member 1430 also has an inner arc radius R of between about 10 mm and about 50 mm. More preferably, the arc radius R of the heel weight member 1430 is between about 15 mm and 40 mm and is less than ½ the blade length. The heel weight member 1430 also includes welding grooves 1431 as a welding area to secure the heel weight member 1430 within the hosel cavity 1432. When the heel weight member 1430 is inserted into the hosel cavity 1432, preferably at least 80% of the heel weight mass is located further heelward (in the x direction) of the heel-side front wall 1436. More preferably, the all of the heel weight member mass is located heelward of the heel-side front wall 1436 such that the shaft axis SA intersects the heel weight member 1430 below the hosel 1416.

The toe weight member 1428 is also formed of tungsten having a specific gravity of about 15-20 g/cm$^3$ and is coupled to a toe portion of the hollow cavity 1426. The toe weight member 1428 is preferably located in the lower (y direction) toe portion of the hollow cavity 1426. Preferably, the toe weight member includes welding grooves 1429 for securing the weight member to the iron body 1400 before the face insert 1410 is welded to the body 1400.

Preferably, as set forth in Table VIII below, the toe weight member 1428 is greater than about 65 grams and comprises about 25%-40% of the long iron club head mass and mid iron club head mass. The long iron head and mid iron head further comprises the heel weight member 1430, also formed of tungsten that is about 10 to 25 grams for the long iron and 25 to 40 grams for the mid irons. As stated above, the heel weight members 1430 are coupled into the hosel cavity 1432 formed in the lower, front portion of the iron body 1400 below the hosel 1416 such that the shaft axis SA intersects the heel weight member 1430. Preferably, the heel weight member 1430 comprises about 5%-10% of the long iron head mass and comprises about 8%-15% of the mid iron head mass. Preferably, the mass of the heel weight members increases with loft through the set. In this embodiment, the heel weight member 1430 is preferably secured in the hosel cavity 1432 by a weld bead formed in the weld groove 1431.

Figure 28:
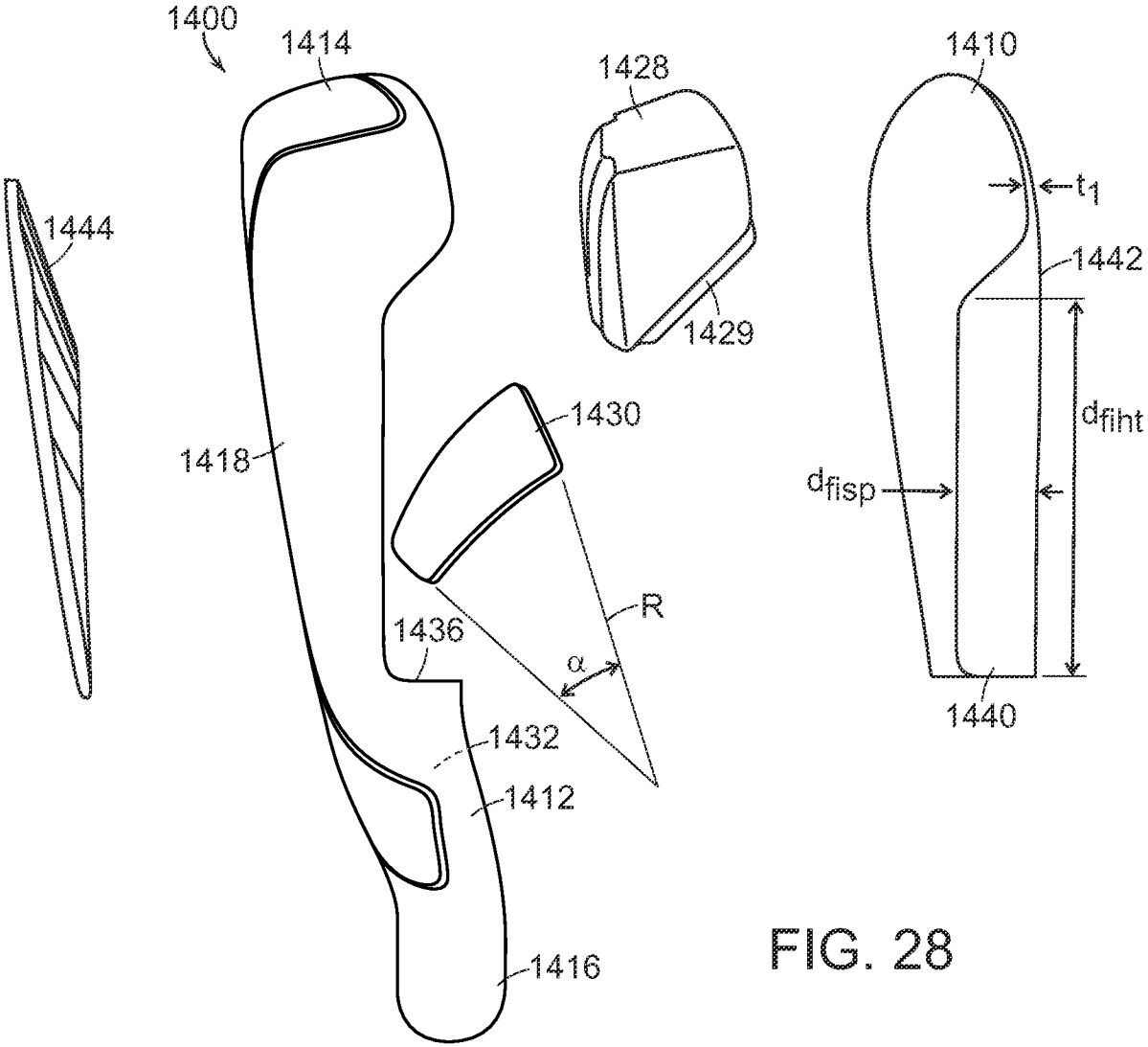
FIG. 28 is an exploded view of the iron in FIG. 26 from a sole perspective.
Figure 29:
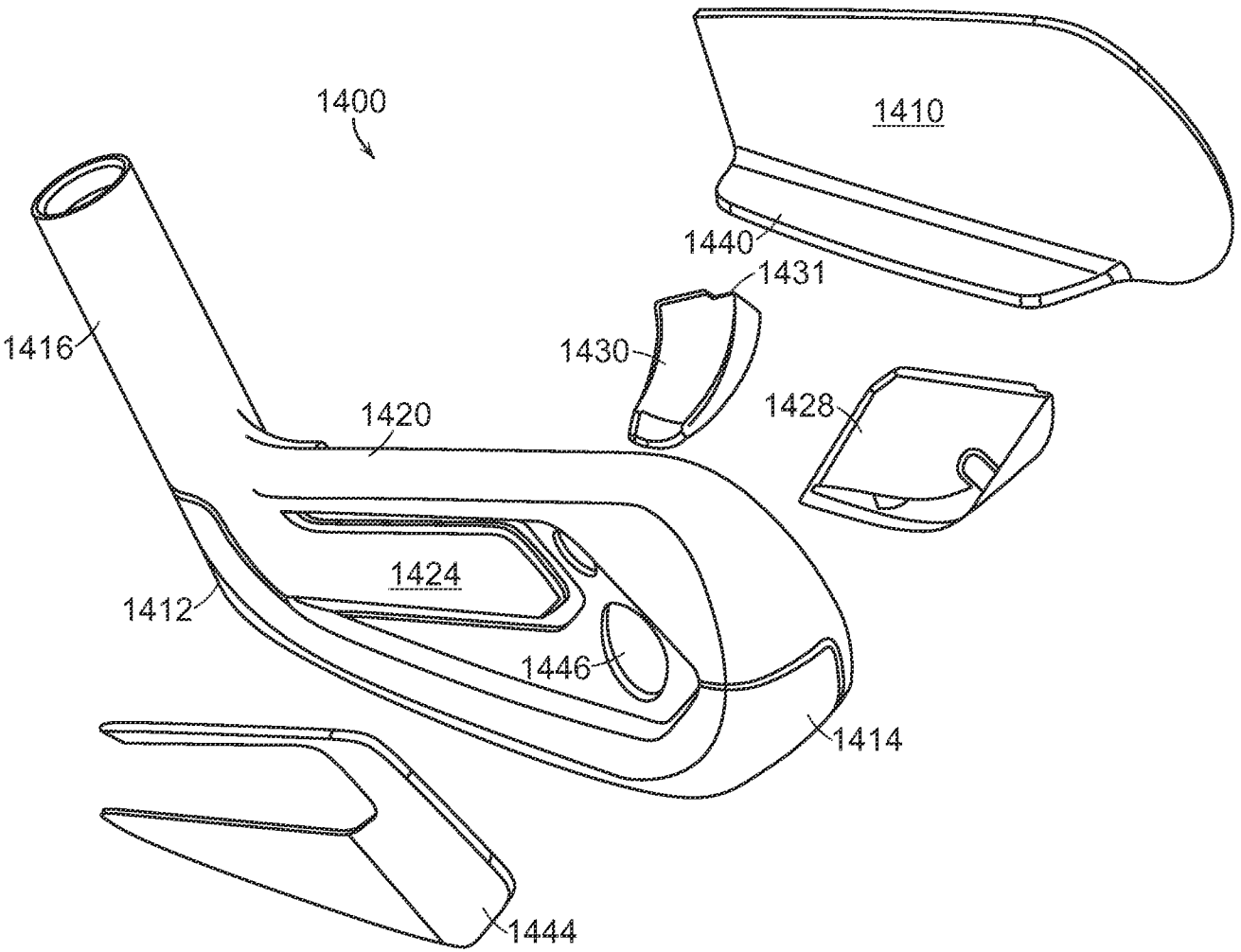
FIG. 29 is an exploded view of the iron in FIG. 26 from a back perspective.

As shown in FIGS. 28 and 29, the face insert 1410 includes a face insert sole portion 1440 that extends from the leading edge 1442 toward the back wall 1424 (in the z direction). Preferably, the face insert sole portion 1440 extends in the front-to-back direction from the leading edge 1442 a distance $d_{fisp}$ that is at least 25% of the sole width. Moreover, it is preferred that the face insert sole portion 1440 extends from the heel-side front wall 1436 toward the toe 1414 (the x direction). Preferably, the face insert sole portion 1440 has a length $d_{fiht}$ in the heel-to-toe direction that is between 50% and 80% of the blade length. This enables the face insert 1410 to form a majority of the front portion of the sole, but allows the body portion of the sole 1418 to hold the toe weight member 1428.

In the preferred set, the mid iron has the same or similar construction as the long iron, and thus, similarly comprises a steel, hollow body with a heel, a toe, a topline, a sole, and a hosel. As set forth in Table VIII below, the toe weight member for at least one of the mid irons is also formed of greater than 65 grams of tungsten, and more preferably greater than 70 grams of tungsten. The toe weight member 1428 for the mid iron preferably comprises about 25%-40% of the mid iron head mass. The mass of the toe weight member preferably increases with loft through the set as set forth in Table VIII below. Within the preferred set, there are preferably at least two long irons and two mid irons that include toe weights 1428 and the mass of the toe weights increases with loft. Also, within the preferred set, there are preferably at least two long irons and two mid irons that include heel weights 1430 and the mass of the heel weights increases with loft.

The club heads according to the present invention have high Moment of Inertias. Because they have such large tungsten weight members, the Moment of Inertia about the y-axis (34 shown in FIG. 2), MOIy, is greater than 230 kg-mm$^2$ for all of the irons, and more preferably, greater than about 260 kg-mm$^2$ for all of the irons. Still further, the irons in the preferred set as presented in Tables VIII and IX below have medium blade lengths, that is between 80 mm and 84 mm. Thus, the MOIy to blade length ratio is very high. More particularly, the MOIy to blade length ration is greater than about 3 kg-mm, and more preferably, between about 3.0 kg-mm and 3.5 kg-mm.

Figure 26:
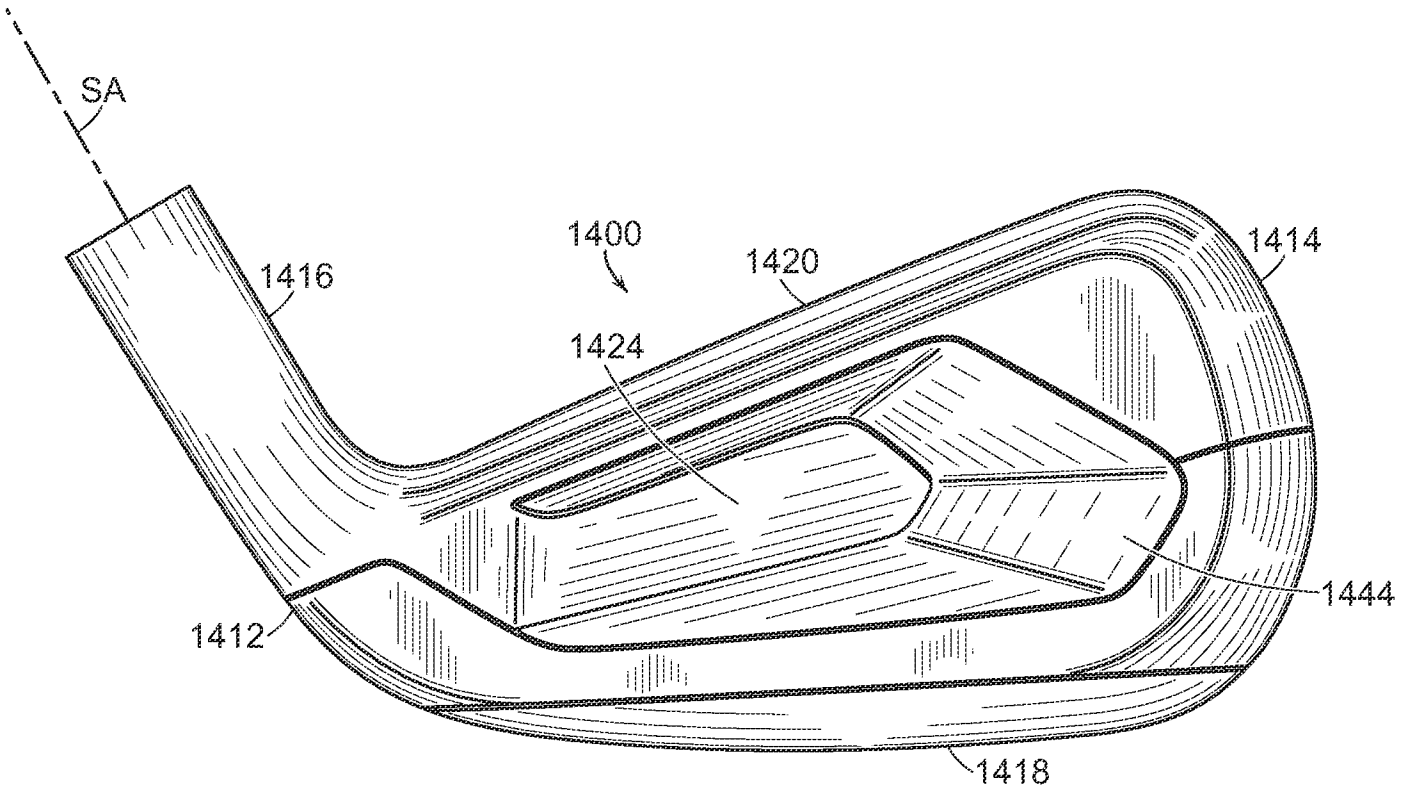
FIG. 26 is a back view of an iron according to the present invention.

The club heads according to the present invention have more consistent Moment of Inertias about the shaft axis (SA shown in FIG. 26). Because the tungsten heel weight members 1430 are located in the hosel cavity 1432 such that the shaft axis SA intersects the heel weight members 1430, the Moment of Inertia about the shaft axis, $MOI_{SA}$, is less than 700 kg-mm$^2$ for all of the irons, and more preferably, between about 650 kg-mm$^2$ and 700 kg-mm$^2$ for all of the irons. More particularly, the long irons have a $MOI_{SA}$ that is with 10% of the $MOI_{SA}$ for the mid irons and more preferably within 5%. Preferably, [(mid iron $MOI_{SA}$−long iron $MOI_{SA}$)/mid iron $MOI_{SA}$]*100<5. Also, the mid irons have a $MOI_{SA}$ that is within 10% of the $MOI_{SA}$ for the short irons and more preferably within 5%. Preferably, [(short iron $MOI_{SA}$−mid iron $MOI_{SA}$)/short iron $MOI_{SA}$]*100<5. Still further, the long irons have a $MOI_{SA}$ that is with 10% of the $MOI_{SA}$ for the short irons and more preferably within 5%. Preferably, [(short iron $MOI_{SA}$−long iron $MOI_{SA}$)/short iron $MOI_{SA}$]*100<5.

Moreover, because the mid irons and the long irons are hollow, the Center of Gravity is relatively deep. More particularly, the Center of Gravity depth from the face center toward the back wall 1424 (in the z direction), CGz, is preferably greater than 6 mm for all of the irons. In a preferred embodiment, the CGz can be between 7.5 mm and 8.5 mm through the set. Preferably, the CGz is almost 1/10 of the blade length for the long irons and mid irons.

Also, the Center of Gravity from the ground, CGy, is very low through the set. As set forth in Table IX below, preferably, the center of gravity in the y direction, CGy, is less than about 18 mm from a ground surface for the long irons and less than about 19 mm for the mid irons and short irons when the club head is in the standard address position.

TABLE VIII

| Club Number | 4 | 5 | 6 | 7 | 8 | 9 | P | W |
|---|---|---|---|---|---|---|---|---|
| loft | 21 | 24 | 27 | 30 | 34 | 38 | 43 | 48 |
| Total Mass (g) | 245 | 252 | 259 | 265 | 273 | 281 | 286 | 289 |
| Body Mass (g) | 93 | 93 | 93 | 93 | 218 | 224 | 228 | 231 |
| Face Mass (g) | 52 | 52 | 52 | 52 | 50 | 51 | 51 | 51 |
| Toe W (g) | 68 | 72 | 75 | 78 | | | | |
| Heel W (g) | 22 | 25 | 28 | 31 | | | | |
| Medallion (g) | 3.5 | 3.5 | 3.5 | 3.5 | 3.3 | 3.3 | 3.3 | 3.3 |
| Steel Mass % | 59 | 58 | 56 | 58 | 98 | 98 | 98 | 98 |
| W Mass % | 37 | 38 | 40 | 41 | | | | |

TABLE IX

| Club Number | 4 | 5 | 6 | 7 | 8 | 9 | P | W |
|---|---|---|---|---|---|---|---|---|
| Blade Length (mm) | 83 | 83 | 82 | 82 | 82 | 81 | 81 | 81 |
| Toe Height (mm) | 55 | 55 | 55 | 56 | 56 | 56 | 57 | 57 |
| Scoreline Width (mm) | 54 | 54 | 54 | 54 | 54 | 53 | 53 | 53 |
| Sole Width Center (mm) | 22 | 21 | 21 | 20 | 20 | 19 | 19 | 18 |
| CGy (mm) | 17.7 | 17.8 | 17.9 | 18.0 | 18.3 | 18.5 | 18.6 | 18.6 |

TABLE IX-continued

| Club Number | 4 | 5 | 6 | 7 | 8 | 9 | P | W |
|---|---|---|---|---|---|---|---|---|
| CGz (mm) | 7.5 | 7.5 | 7.4 | 7.4 | 7.8 | 7.9 | 8.0 | 8.2 |
| MOIy (kg-mm$^2$) | 270 | 275 | 284 | 290 | 274 | 279 | 284 | 288 |
| $MOI_{SA}$ (kg-mm$^2$) | 658 | 667 | 674 | 678 | 677 | 684 | 685 | 690 |

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

What is claimed is:

1. A golf club comprising:

a club head having a club head mass;

a y-axis extending vertically through a face center of the club head and a Moment of Inertia about the y-axis, a body made of steel comprising a heel, a toe, a topline, a sole, a hosel that defines a shaft axis, and a back wall, a face insert formed of steel and having a face insert mass, the face insert having a thickness of 1.8 mm or less and an Ultimate Tensile Strength of 2000 MPa or greater, the face insert being welded to the body to form a hollow cavity between the face insert and the back wall;

a weight member formed of tungsten and is coupled in a lower portion of the hollow cavity and has a weight member mass that comprises greater than 25% of the club head mass; and wherein the face insert mass is less than the weight member mass, and wherein the sole has a sole width and the face insert includes a face insert sole portion that extends from a leading edge of the face insert toward the back wall a distance in front-to-back direction that is at least 25% of the sole width.

2. The golf club of claim 1, wherein the club head comprises a heel weight member that comprises between 5% and 10% of the club head mass.

3. The golf club of claim 1, wherein the Moment of Inertia about the y-axis is greater than 230 kg-mm2.

4. The golf club of claim 1, wherein the Moment of Inertia about the y-axis is greater than 260 kg-mm2.

5. The golf club of claim 1, wherein the club head has a Moment of Inertia about the shaft axis that is between 650 kg-mm2 and 700 kg-mm2.

6. The golf club of claim 1, wherein the club head has a center of gravity in a y direction from a ground surface, CGy, that is less than about 18 mm.

7. The golf club of claim 1, wherein the club head has a center of gravity depth from the face center toward the back wall, CGz, that is greater than 6 mm.

8. The golf club of claim 1, wherein the face insert has a perimeter region surrounding a center that is thicker than the perimeter region and a smooth transition zone connects the center to the perimeter region.

9. The golf club of claim 1, wherein the club head further comprises a medallion that covers an aperture in the back wall.

10. A golf club comprising:

a club head having a club head mass;

a y-axis extending vertically through a face center of the club head and a Moment of Inertia about the y-axis, a body made of steel comprising a heel, a toe, a topline, a sole, a hosel defining a shaft axis, and a back wall, a face insert formed of steel and having a face insert mass, the face insert having a thickness of 1.8 mm or less and an Ultimate Tensile Strength of 2300 MPa or greater, the face insert being welded to the body to form a hollow cavity between the face insert and the back wall;

a weight member formed of tungsten and is coupled in a lower portion of the hollow cavity and has a weight member mass that comprises greater than 25% of the club head mass; and wherein the face insert mass is less than the weight member mass, and wherein the sole has a sole width and the face insert includes a face insert sole portion that extends from a leading edge of the face insert toward the back wall a distance in front-to-back direction that is at least 25% of the sole width.

11. The golf club of claim 10, wherein the club head has a Moment of Inertia about the shaft axis that is between 650 kg-mm2 and 700 kg-mm2.

12. The golf club of claim 10, wherein the club head has a center of gravity in a y direction from a ground surface, CGy, that is less than about 18 mm.

13. The golf club of claim 10, wherein the club head has a center of gravity depth from the face center toward the back wall, CGz, that is greater than 6 mm.

* * * * *